US009663892B2

(12) United States Patent
Del Pos et al.

(10) Patent No.: US 9,663,892 B2
(45) Date of Patent: May 30, 2017

(54) LAUNDRY WASHING MACHINE

(75) Inventors: Maurizio Del Pos, Pordenone (IT); Daniele Favaro, Pramaggiore (IT); Andrea Zattin, Solesino (IT)

(73) Assignee: Electrolux Home Products Corporation N.V., Brussels (BE)

( * ) Notice: Subject to any disclaimer, the term of this patent is extended or adjusted under 35 U.S.C. 154(b) by 480 days.

(21) Appl. No.: 14/236,519

(22) PCT Filed: Jul. 24, 2012

(86) PCT No.: PCT/EP2012/064514
§ 371 (c)(1),
(2), (4) Date: Jan. 31, 2014

(87) PCT Pub. No.: WO2013/017482
PCT Pub. Date: Feb. 7, 2013

(65) Prior Publication Data

US 2014/0165665 A1 Jun. 19, 2014

(30) Foreign Application Priority Data

Aug. 1, 2011 (EP) ..... 11176078

(51) Int. Cl.
*D06F 39/02* (2006.01)
*D06F 39/00* (2006.01)

(52) U.S. Cl.
CPC ..... *D06F 39/02* (2013.01); *D06F 39/007* (2013.01)

(58) Field of Classification Search
CPC ..... D06F 37/02
See application file for complete search history.

(56) References Cited

U.S. PATENT DOCUMENTS 3,363,637 A 1/1968 Rumbaugh et al.
4,066,393 A 1/1978 Morey et al.
(Continued)

FOREIGN PATENT DOCUMENTS

DE 2346801 A1 4/1974
DE 3520202 A1 12/1986
(Continued)

OTHER PUBLICATIONS

Sep. 30, 2013 International Search Report issued in International Application No. PCT/EP2012/064514.
(Continued)

*Primary Examiner* — Jason Ko
(74) *Attorney, Agent, or Firm* — Banner & Witcoff, Ltd.

(57) ABSTRACT

A laundry washing machine includes an outer casing, a washing tub arranged inside the casing directly facing a laundry loading/unloading opening realized in a front wall of the casing, a rotatable drum arranged in an axially rotating manner inside the washing tub and structured for receiving the laundry to be washed, a detergent dispenser which is housed inside the casing between the washing tub and the top wall of the casing and is structured for feeding into the washing tub a detergent, softener and/or other washing agent mixed with fresh water arriving from the water mains, and a water softening device which is arranged inside the boxlike casing and is structured for reducing the hardness degree of the fresh water supplied to the washing tub. The water softening device in turn includes a water-softening agent container filled with a water softening agent able to reduce the hardness degree of the fresh water supplied to the washing tub, and a regeneration-agent reservoir which is fluidly connected to said water-softening agent container and is structured to receive a salt or other regeneration agent for performing a regeneration of the water softening func-
(Continued)

tion of said water softening agents. At least one among the water-softening agent container and the regeneration-agent reservoir is a stand-alone modular component-part which is provided with mechanical coupling means structured for allowing rigid fastening of the stand-alone modular component-part to the detergent dispenser.

20 Claims, 12 Drawing Sheets

(56) References Cited

U.S. PATENT DOCUMENTS

| | | | | |
|---|---|---|---|---|
| 2005/0224100 | A1 | 10/2005 | Maunsell et al. | |
| 2005/0274156 | A1 | 12/2005 | Yang | |
| 2006/0075790 | A1 | 4/2006 | Jeon et al. | |
| 2008/0000098 | A1 | 1/2008 | Choi et al. | |
| 2009/0095750 | A1* | 4/2009 | Vitan | A47L 15/4253 220/23.83 |
| 2009/0266115 | A1 | 10/2009 | Cao et al. | |
| 2010/0000024 | A1* | 1/2010 | Hendrickson | D06F 33/02 8/137 |

FOREIGN PATENT DOCUMENTS

| | | | |
|---|---|---|---|
| DE | 3527182 | A1 | 2/1987 |
| DE | 3736311 | A1 | 5/1989 |
| DE | 3819664 | A1 | 12/1989 |
| DE | 3839203 | A1 | 5/1990 |
| DE | 291979 | A5 | 7/1991 |
| DE | 8718054 | U1 | 2/1993 |
| DE | 102005046391 | A1 | 4/2006 |
| EP | 0190675 | A2 | 8/1986 |
| EP | 0437713 | A2 | 7/1991 |
| EP | 1085118 | A2 | 3/2001 |
| EP | 1568815 | A1 | 8/2005 |
| EP | 1598467 | A1 | 11/2005 |
| EP | 1607509 | A1 | 12/2005 |
| EP | 1645675 | A1 | 4/2006 |
| EP | 1721558 | A2 | 11/2006 |
| EP | 1959043 | A1 | 8/2008 |
| WO | 0212609 | A1 | 2/2002 |
| WO | 2011042341 | A1 | 4/2011 |

OTHER PUBLICATIONS

Jan. 20, 2012 Extended Search Report issued in European Application No. 11176078.1.

Nov. 15, 2012 International Search Report issued in International Application No. PCT/EP2012/064655.

Feb. 12, 2012 Extended Search Report issued in European Application No. 11176089.8.

Jan. 2, 2013 International Search Report issued in International Application No. PCT/EP2012/064766.

Jan. 23, 2012 Extended Search Report issued in European Application No. 11176075.7.

Nov. 13, 2012 International Search Report issued in International Application No. PCT/EP2012/064817.

Jan. 23, 2012 Extended Search Report issued in European Application No. 11176088.0.

* cited by examiner

LAUNDRY WASHING MACHINE

BACKGROUND

Embodiments of the present invention relate to a laundry washing machine.

In particular, embodiments of the present invention relate to a front-loading home laundry washing machine, to which the following description refers purely by way of example without this implying any loss of generality.

In particular, the present invention relates to a front-loading home laundry washing machine, to which the following description refers purely by way of example without this implying any loss of generality.

As is known, currently marketed front-loading home laundry washing machines generally comprise: a substantially parallelepiped-shaped boxlike outer casing structured for resting on the floor; a substantially bell-shaped washing tub which is suspended in floating manner inside the casing, directly facing a laundry loading/unloading through opening realized in the front wall of the casing; a substantially cylindrical elastically-deformable bellows, which connects the front opening of the washing tub to the laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; a substantially cylindrical, bell-shaped revolving drum structured for housing the laundry to be washed, and which is housed inside the washing tub in axially rotating manner about its substantially horizontally-oriented longitudinal axis, and with its concavity facing the laundry loading/unloading opening; and finally an electrically-powered motor assembly which is structured for driving into rotation the revolving drum about its longitudinal axis inside the washing tub.

This type of home laundry washing machines is furthermore provided with a drawer detergent dispenser which is located inside the boxlike casing, immediately above the washing tub, and is structured for selectively feeding into the washing tub, according to the washing cycle manually-selected by the user via a control panel usually located on the front wall of the boxlike casing, a given amount of detergent, softener and/or other washing agent suitably mixed with the fresh water arriving from the water mains, or even merely a given amount of fresh water arriving from the water mains.

More specifically, the detergent dispenser generally comprises a detergent drawer which is fitted in a manually extractable manner into an internal drawer housing whose entrance is located on front wall of the boxlike casing, above the porthole door. This detergent drawer is usually divided into a number of detergent compartments each of which is manually fillable with a corresponding detergent product, and the detergent dispenser furthermore comprises a drawer flush circuit which is structured to spill/pour a given amount of fresh water drawn from the water mains selectively and alternatively into each detergent compartment of the detergent drawer for flushing the detergent, softener or other washing agent out of the compartment and down into a funnel-shaped catchment basin which is realized on the bottom of the drawer housing and directly communicates with the inside of the washing tub via a drain duct.

As is known the hardness of the fresh water drawn from the water mains deeply negatively influences the cleaning efficiency of the detergents and softeners used in the washing cycle, thus the user is usually requested to considerably increase the amount of detergent and softener used in the washing cycle when the hardness degree of the tap water is too high.

To solve this problem the European patent application No. 1085118 discloses a front-loading home laundry washing machine provided with an internal water softening device capable of reducing, during each washing cycle, the hardness degree of the tap water used in the pre-washing and washing phases of the washing cycle. This water softening device uses ion-exchange resins to restrain calcium and magnesium ions (Ca++ an Mg++) dissolved in the tap water channeled to the washing tub, and uses brine (i.e. salt water) to periodically regenerate these ion-exchange resins. Salt water, in fact, is able to remove from the ion-exchange resins the calcium and magnesium ions previously combined/fixed to said resins.

Unluckily integration of the salt reservoir on the back of the detergent drawer has brought to a very complicated detergent-dispenser structure with a consequent significant increase in the detergent dispenser overall production cost.

Another drawback associated to the arrangement of the salt reservoir on the back of the detergent drawer is that the capacity of the salt reservoir is limited, and that the brine formed inside the salt reservoir may accidentally come out of the salt reservoir during normal extraction and insertion of the detergent drawer and form, on the bottom of the drawer housing, relevant salt deposits that, in long term, may hinder extraction and insertion of the detergent drawer and/or impede the correct alignment of the salt reservoir with the resin container located immediately beneath said salt reservoir, with all problem concerned.

Last but not less important, the brine accidentally coming out of the salt reservoir may fall into the funnel-shaped catchment basin realized on the bottom of the drawer housing. This catchment basin communicates with the upper portion of the washing tub, thus the brine may fall down onto the outer surface of the revolving drum that is generally made of metal, and therefore cause a quick rusting up of the revolving drum.

SUMMARY OF SELECTED INVENTIVE ASPECTS

An aim of the present invention is to realize an internal water softening device designed to eliminate the drawbacks referred above.

In compliance with the above aims, according to embodiments of the present invention there is provided a laundry washing machine comprising an outer casing, a washing tub arranged inside said casing directly facing a laundry loading/unloading opening realized in a front wall of said casing, a rotatable drum arranged in axially rotating manner inside the washing tub and structured for receiving the laundry to be washed, a detergent dispenser which is structured for supplying detergent into the washing tub, and a water softening device which is arranged inside the boxlike casing and is structured for reducing the hardness degree of the fresh water supplied to the washing tub; the water softening device in turn comprising a water-softening agent container filled with a water softening agent able to reduce the hardness degree of the fresh water supplied to the washing tub, and a regeneration-agent reservoir structured to receive a salt or other regeneration agent for performing a regeneration of the water softening function of said water softening agents; wherein at least one among the water-softening agent container and the regeneration-agent reservoir is a stand-alone modular component-part which is provided with mechanical coupling means structured for allowing rigid fastening of said stand-alone modular component-part to the detergent dispenser.

Preferably, though not necessarily, the laundry washing machine is furthermore characterized in that the detergent dispenser is provided with a first housing which extends inside the casing, and in that at least one among the water-softening agent container and the regeneration-agent reservoir is structured for being rigidly fastened to the first housing of said detergent dispenser.

Preferably, though not necessarily, the laundry washing machine is furthermore characterized in that the regeneration-agent reservoir of the water softening device is arranged beside the first housing of the detergent dispenser.

Preferably, though not necessarily, the laundry washing machine is furthermore characterized in that the regeneration-agent reservoir is arranged beside the first housing of the detergent dispenser, in a direction locally substantially parallel to the front wall of the casing.

Preferably, though not necessarily, the laundry washing machine is furthermore characterized in that the regeneration-agent reservoir is provided with mechanical coupling means structured for allowing rigid fastening of the regeneration-agent reservoir to a sidewall of the first housing of said detergent dispenser.

Preferably, though not necessarily, the laundry washing machine is furthermore characterized in that the water-softening agent container is a stand-alone modular component-part which is provided with mechanical coupling means structured for allowing rigid fastening and fluidical connection of the water-softening agent container to the bottom of the regeneration-agent reservoir.

Preferably, though not necessarily, the laundry washing machine is furthermore characterized in that said water-softening agent container is located beneath said regeneration-agent reservoir within a seat delimited by the lateral wall of the casing, the upper portion of the washing tub and the front wall of the casing.

Preferably, though not necessarily, the laundry washing machine is furthermore characterized in that the water-softening agent container is a stand-alone modular component-part which is provided with mechanical coupling means structured for allowing rigid fastening and fluidical connection of the water-softening agent container to the detergent dispenser.

Preferably, though not necessarily, the laundry washing machine is furthermore characterized in that the detergent dispenser is provided with complementary mechanical coupling means structured for engaging the mechanical coupling means of said regeneration-agent reservoir and/or said water-softening agent container.

Preferably, though not necessarily, the laundry washing machine is furthermore characterized in that the detergent dispenser is exposed or exposable to the outside of the casing through the front wall of said casing.

Preferably, though not necessarily, the laundry washing machine is furthermore characterized in that said detergent dispenser comprises a detergent container which is fillable with a given quantity of detergent, softener and/or other washing agent, and is housed inside the casing into said first housing.

Preferably, though not necessarily, the laundry washing machine is furthermore characterized in that said detergent container is movable inside said first housing so as to be at least partly extractable from the first housing through a first opening on the front wall of the casing.

Preferably, though not necessarily, the laundry washing machine is furthermore characterized in that the regeneration-agent reservoir of the water softening device is exposed or exposable to the outside of the casing through the front wall of said casing.

Preferably, though not necessarily, the laundry washing machine is furthermore characterized in that the regeneration-agent reservoir comprises a regeneration-agent container which is fillable with a given quantity of regeneration agents, and is housed inside the casing into a corresponding second housing or seat.

Preferably, though not necessarily, the laundry washing machine is furthermore characterized in that the detergent dispenser comprises also the second housing or seat of said regeneration-agent reservoir.

Preferably, though not necessarily, the laundry washing machine is furthermore characterized in that said regeneration-agent container is movable inside said second housing or seat so as to be at least partly extractable from the second housing or seat through a second opening on the front wall of the casing.

Preferably, though not necessarily, the laundry washing machine is furthermore characterized in that the displacement direction of the regeneration-agent container inside the second seat is locally substantially parallel to the displacement direction of the detergent container inside the first seat.

Preferably, though not necessarily, the laundry washing machine is furthermore characterized in that said detergent container and said regeneration-agent container are able to jut out from the front wall of the casing while remaining locally substantially parallel to one another.

Preferably, though not necessarily, the laundry washing machine is furthermore characterized in that said water softening device furthermore comprises a water supply circuit which is structured for selectively spilling/pouring a given amount of fresh water into the regeneration-agent reservoir to at least partly dissolve the regeneration agents stored therein; the water-softening agent container communicating with said regeneration reservoir for receiving said solution of regeneration agents.

Preferably, though not necessarily, the laundry washing machine is furthermore characterized in that the water supply circuit comprises electrically-controlled auxiliary valve means which are interposed between the water mains and the regeneration-agent reservoir and are able to control/regulate the flow of fresh water towards the regeneration-agent reservoir.

Preferably, though not necessarily, the laundry washing machine is furthermore characterized by also comprising electrically-controlled main valve means which are arranged between the detergent dispenser and the water mains, and are able to control/regulate the flow of fresh water from the water mains towards the detergent dispenser and/or the washing tub.

Preferably, though not necessarily, the laundry washing machine is furthermore characterized in that the water-softening agent container is arranged between the detergent dispenser and said main valve means.

Preferably, though not necessarily, the laundry washing machine is furthermore characterized in that the water softening device is furthermore provided with a first water drain line which is structured for selectively draining the brine or fresh water out of the resin container.

Preferably, though not necessarily, the laundry washing machine is furthermore characterized in that said first water drain line comprises an exhaust duct which connects the bottom of the resin container either with the washing tub, with the drain sump or with the water filtering assembly of the laundry washing machine, and an on-off valve which is located along the exhaust duct for controlling the outflow of the brine or fresh water from the resin container.

Preferably, though not necessarily, the laundry washing machine is furthermore characterized in that said detergent dispenser comprises: a detergent drawer which is inserted in a manually extractable manner into a first drawer housing which extends inside the casing above the washing tub, starting from a front entrance or opening which is realized on the front wall of casing above the laundry loading/unloading opening; and a drawer flush circuit which is structured for selectively spilling/pouring a given amount of fresh water arriving from the water mains into the detergent drawer for flushing the detergent, softener or other washing agent out of the detergent drawer and down into the bottom of the first drawer housing which communicates with the inside of the washing tub.

Preferably, though not necessarily, the laundry washing machine is furthermore characterized in that the water-softening agent container is arranged between said main valve means and the drawer flush circuit of the detergent dispenser.

Preferably, though not necessarily, the laundry washing machine is furthermore characterized in that the detergent drawer is provided with a number of detergent compartments each fillable with a respective detergent product, and in that the drawer flush circuit comprises: a sprinkler head which is located inside the first drawer housing above the detergent drawer, and is provided with a number of shower-making portions each of which is aligned to a corresponding detergent compartment of the detergent drawer and is structured for feeding a shower of water droplets by gravity only into said detergent compartment: and a hydraulic distributor assembly which is located upstream of the sprinkler head, and is structured for channeling the fresh water arriving from the water mains selectively and alternatively into one of the shower-making portions of the sprinkler head.

Preferably, though not necessarily, the laundry washing machine is furthermore characterized in that the water-softening agent container is arranged between said valve means and said hydraulic distributor assembly, so as to be crossed by the fresh water directed to the inlet of said hydraulic distributor assembly.

Preferably, though not necessarily, the laundry washing machine is furthermore characterized in that the first drawer housing is substantially basin-shaped, and that the sprinkler head comprises a substantially flat first lid or cover which is designed to close the top of the first drawer housing; said first lid or cover being divided into a number of shower-making portions, each of which is vertically aligned to a corresponding detergent compartment of the detergent drawer and is structured for receiving the fresh water from the hydraulic distributor assembly and for feeding a shower of water droplets only into the detergent compartment located immediately beneath.

Preferably, though not necessarily, the laundry washing machine is furthermore characterized in that said regeneration-agent reservoir comprises a salt drawer which is inserted in a manually extractable manner into a second drawer housing which extends inside the casing, beside the detergent dispenser, starting from a front entrance or opening which is realized on the front wall of casing above the laundry loading/unloading opening.

Preferably, though not necessarily, the laundry washing machine is furthermore characterized in that the second drawer housing is substantially basin-shaped, and that the first lid or cover of the drawer flush circuit is designed to also close the top of said second drawer housing.

Preferably, though not necessarily, the laundry washing machine is furthermore characterized in that the water supply circuit of the water softening device is at least partly integrated in said first lid or cover.

Preferably, though not necessarily, the laundry washing machine is furthermore characterized in that the water supply circuit comprises a first water channel that extends within said first lid or cover and is fluidly connected to said basin-shaped second drawer housing wherein it is fluidly connected to the salt drawer.

Preferably, though not necessarily, the laundry washing machine is furthermore characterized in that the said first water channel branches off from the drawer flush circuit of the detergent dispenser.

Preferably, though not necessarily, the laundry washing machine is furthermore characterized in that the drawer flush circuit furthermore comprises a second water drain line that branches off from the hydraulic distributor assembly.

BRIEF DESCRIPTION OF THE DRAWINGS

A non-limiting embodiment of the present invention will now be described, by way of example, with reference to the accompanying drawings, in which:

FIG. 16 shows a perspective views of a further alternative embodiment of the internal water softening device of the FIG. 1 laundry washing machine, with parts in section and parts removed for clarity; whereas

DETAILED DESCRIPTION OF EXAMPLE EMBODIMENTS

Figure 2:
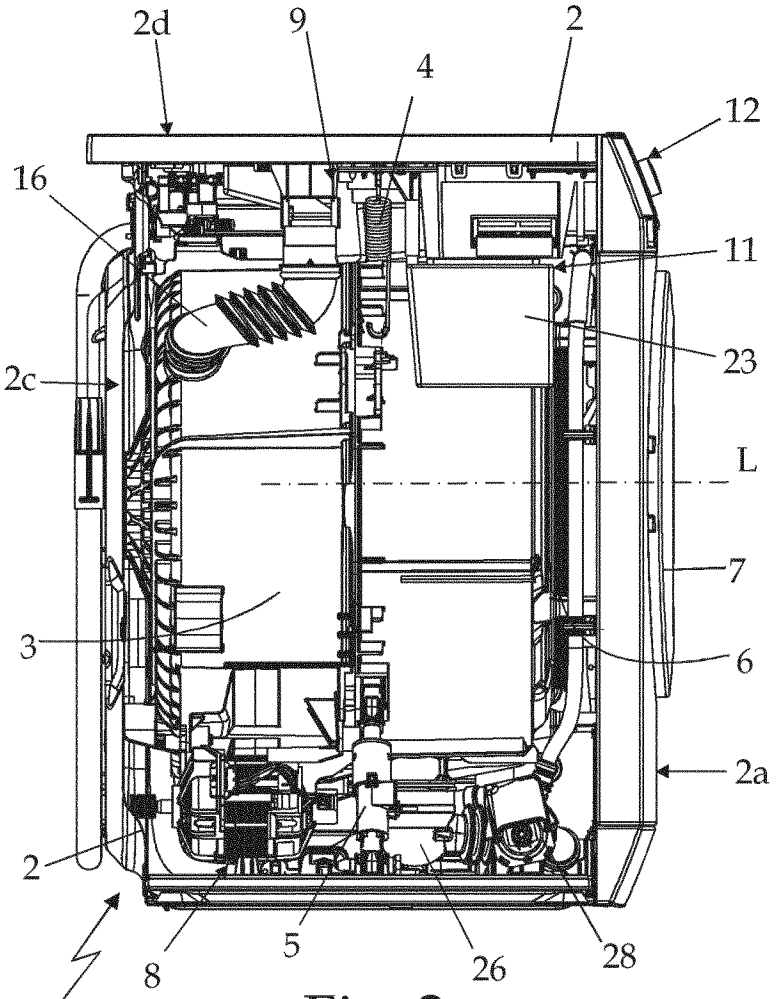
FIG. 2 is a lateral view of the FIG. 1 home laundry washing machine with parts removed for clarity.
Figure 1:
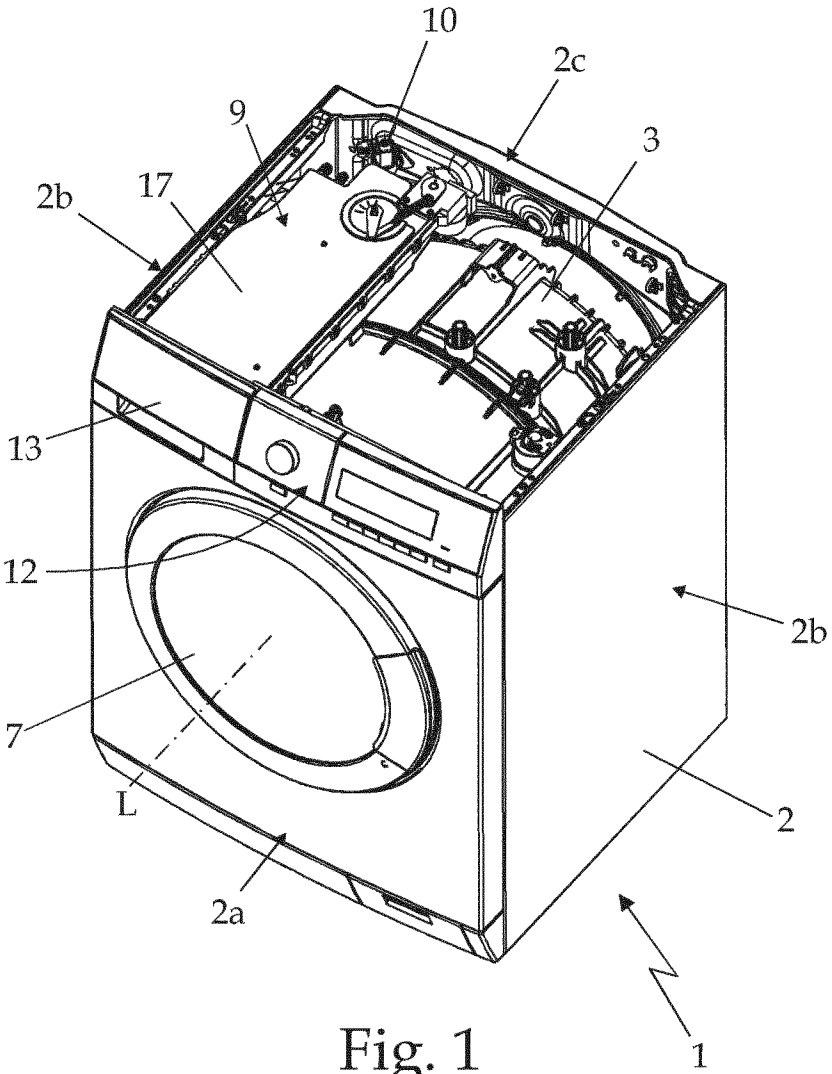
FIG. 1 shows a perspective view of a front-loading, home laundry washing machine realized in accordance with the teachings of the present invention, with parts removed for clarity.
Figure 3:
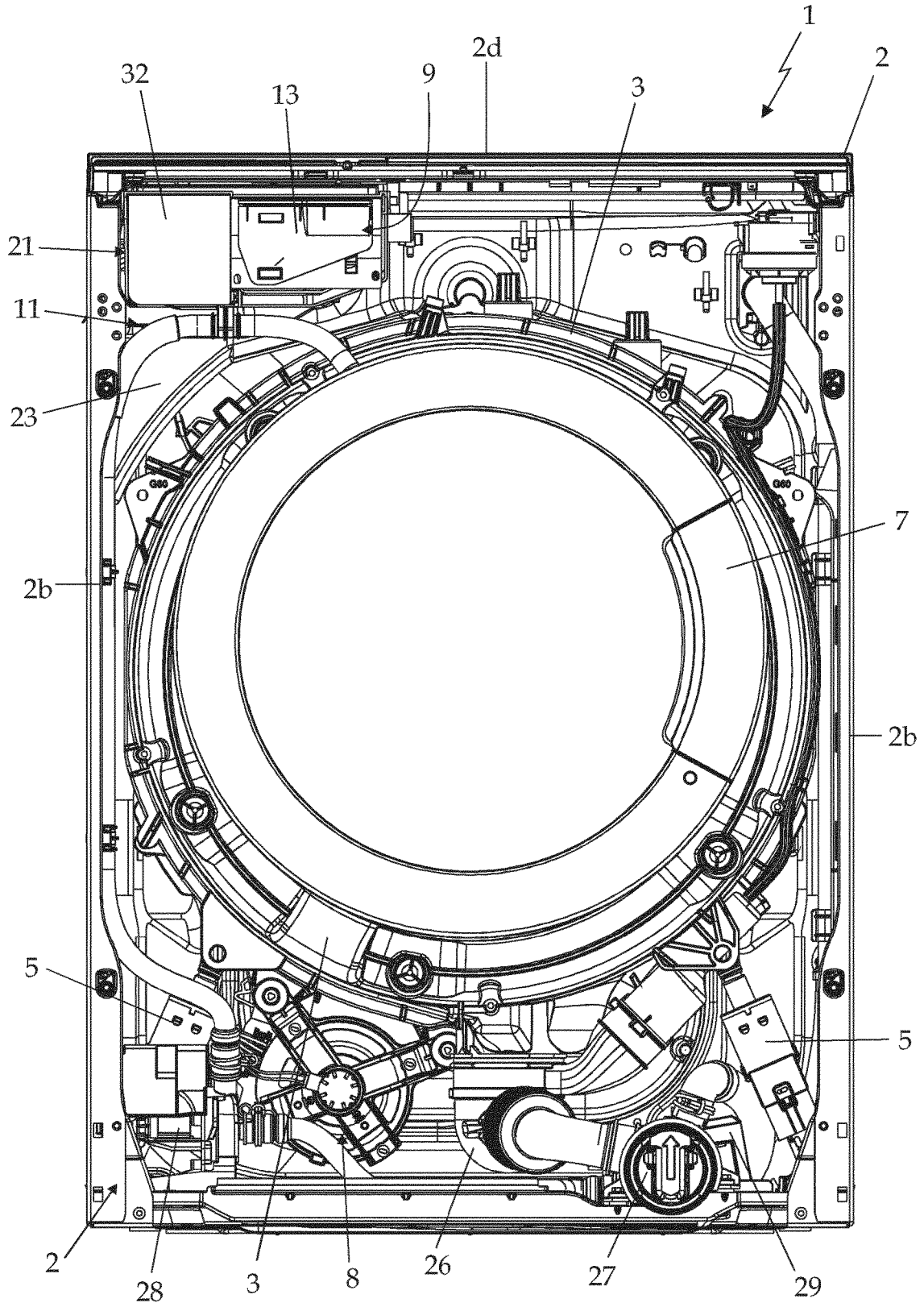
FIG. 3 is a front view of the FIG. 1 laundry washing machine with parts removed for clarity.
Figure 4:
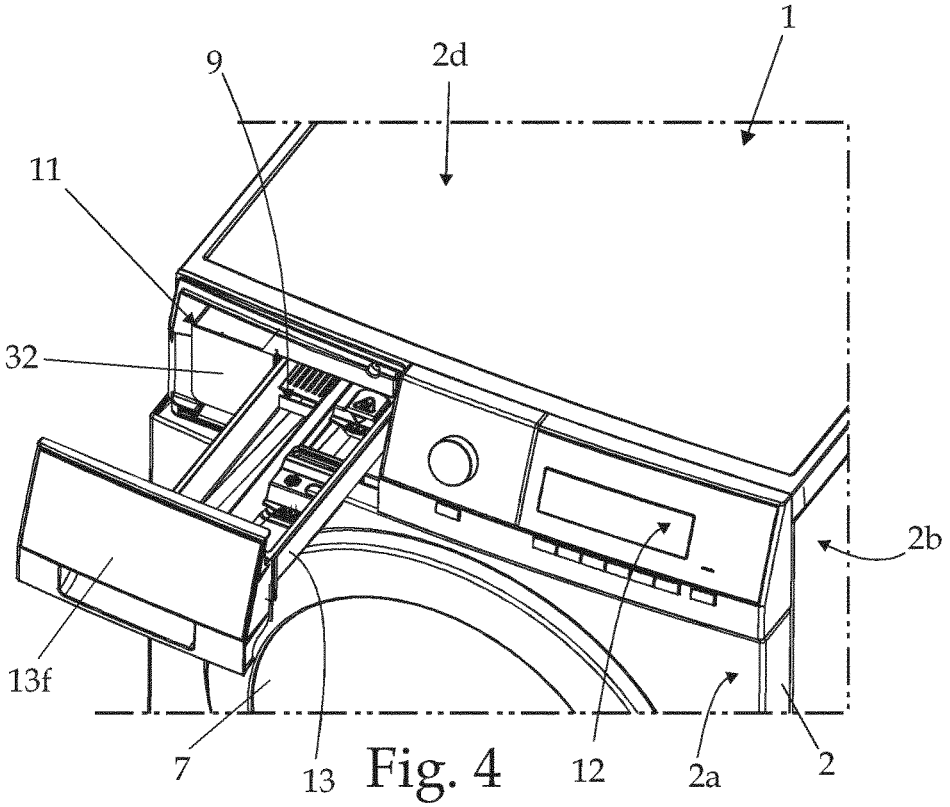
FIG. 4 is a perspective view of the top portion of the FIG. 1 laundry washing machine in a first operating position.

With reference to FIGS. 1, 2 and 3, referral number 1 indicates as a whole a home laundry washing machine which comprises:

- a preferably, though not necessarily, substantially parallelepiped-shaped outer boxlike casing 2 which is structured for resting on the floor and is provided with a front wall 2*a*, two side walls 2*b*, and a rear wall 2*c* all preferably substantially vertically oriented, and a substantially horizontal top wall 2*d;*
- a preferably, though not necessarily, cylindrical, substantially bell-shaped hollow washing tub 3 which is arranged inside the casing 2 preferably suspended in floating manner via a suspension system preferably comprising a number of coil springs 4 and vibration dampers 5, directly facing a laundry loading/unloading pass-through opening realized in the front wall 2*a* of boxlike casing 2;
- a substantially cylindrical, elastically-deformable bellows 6 which connects the front opening of washing tub 3 to the laundry loading/unloading opening formed in the front wall 2*a* of casing 2; and
- a substantially cylindrical, bell-shaped revolving drum (not shown) structured for housing the laundry to be washed, and which is housed in an axially rotating manner inside the washing tub 3 so as to be able to freely rotate about its longitudinal reference axis.

In the example shown, in particular, the revolving drum is housed in axially rotating manner inside the washing tub 3 with its front opening directly faced/aligned to the laundry loading/unloading opening on the front wall 2*a* of casing 2, and the drum rotation axis is preferably arranged locally substantially coincident with the substantially horizontally-oriented longitudinal reference axis L of washing tub 3.

With reference to FIGS. 1, 2 and 3, the laundry washing machine 1 furthermore comprises:

- a porthole door 7 which is hinged to the front wall 2*a* of casing 2 to rotate about a preferably, though non necessarily, vertically-oriented reference axis to and from a closing position in which the peripheral border of the porthole door 7 rests completely on front wall 2*a* for closing the laundry loading/unloading opening and watertight sealing the washing tub 3;
- an electrically-powered motor assembly 8 which is structured for driving into rotation the revolving drum about its longitudinal reference axis inside the washing tub 3;
- a detergent dispenser 9 which is housed inside the casing 2, above the washing tub 3, so as to emerge from the front wall 2*a* of the boxlike casing 2 above the aforesaid laundry loading/unloading opening, and is structured for selectively feeding into the washing tub 3, according to the selected washing cycle, a given amount of detergent, softener and/or other washing agent suitably mixed with the fresh water arriving from the water mains, or even simply a given amount of fresh water arriving from the water mains; and
- an electrically-controlled on-off valve 10 which is arranged between the detergent dispenser 9 and the water mains, and is able to control/regulate the flow of fresh water from the water mains towards the detergent dispenser 9 and/or the washing tub 3.

In addition to the above, the laundry washing machine 1 is furthermore provided with an internal water softening device 11 which is arranged inside the boxlike casing 2 between the on-off valve 10 and the detergent dispenser 9 or even directly the washing tub 3, and is structured for selectively reducing, during each washing cycle, the hardness degree of the fresh water drawn from the water mains and channeled to the detergent dispenser 9 and/or directly to the washing tub 3.

This water softening device is preferably housed inside the boxlike casing 2 beside the detergent dispenser 9 in a direction preferably substantially horizontal and locally substantially parallel to the front wall 2*a* of casing 2, so that both detergent dispenser 9 and water softening device 11 are directly exposed or exposable on the outside of boxlike casing 2, one beside the other, so to be preferably independently accessible by the user at any moment.

With reference to FIGS. 1-5, in particular, the detergent dispenser 9 is arranged inside the casing 2 between the washing tub 3 and the top wall 2*d* of the casing 2, and is provided with a first loading inlet which is exposed or exposable to the outside on the front wall 2*a* of casing 2, above the laundry loading/unloading opening, and is suitable for loading the detergent, softener and/or other washing agent with the detergent dispenser 9.

In other words, the detergent dispenser 9 comprises a detergent container which is fillable with a given quantity of detergent, softener and/or other washing agent, and is housed inside casing 2 into a corresponding housing or seat, and the front wall 2*a* of casing 2 is provided with a corresponding pass-through opening through which the detergent container is accessible by the user.

In the example shown, in particular, the detergent dispenser 9 is located inside the boxlike casing 2, immediately above the washing tub 3, so that the inlet of detergent dispenser 9 is arranged on the front wall 2*a* of the casing 2, immediately above the laundry loading/unloading opening, and preferably beside an appliance control panel 12 that is arranged on the front wall 2*a* of casing 2 above the laundry loading/unloading opening and immediately beneath the top wall 2*d* of casing 2.

With reference to FIGS. 4-9, in the example shown, in particular, the detergent dispenser 9 comprises a detergent drawer 13 which is inserted in a manually extractable manner into a drawer housing or seat 14 which extends substantially horizontally inside the boxlike casing 2, immediately above the washing tub 3, starting from a pass-through front entrance or opening 14*a* which is realized, on the front wall 2*a* of casing 2 immediately above the laundry loading/unloading opening. The detergent drawer 13 of detergent dispenser 9 is therefore movable inside the drawer housing or seat 14 so as to be at least partly extractable from the drawer housing or seat 14 through the front entrance or opening 14*a* on the front wall 2*a* of casing 2.

The detergent dispenser 9 furthermore comprises a drawer flush circuit 15 which is structured for selectively spilling/pouring a given amount of fresh water arriving from the water mains via the on-off valve 10 into the detergent drawer 13 for flushing the detergent, softener or other washing agent out of the detergent drawer 13 and down into a funnel-shaped catchment basin which is formed on the bottom 14*b* of the drawer housing 14, and which communicates with the inside of washing tub 3 via a corresponding supply duct 16 preferably connected to the upper portion of the washing tub 3.

The water softening device 11 is preferably interposed between the on-off valve 10 and the drawer flush circuit 15 of detergent dispenser 9.

With reference to FIGS. 1, 2, 4 and 5, in the example shown, in particular, the detergent drawer 13 is movable inside the drawer housing 14 in a displacement direction which is preferably substantially horizontally-oriented and also locally substantially perpendicular to the front wall 2*a* of casing 2.

Furthermore the detergent drawer 13 is preferably divided into a number of detergent compartments 13*a* (three in the example shown) each of which is manually fillable with a respective washing agent, and the drawer flush circuit 15 is structured for selectively spilling/pouring the fresh water arriving from the water mains selectively and alternatively into the various detergent compartments 13*a* of the detergent drawer 13 for flushing the detergent or softener out of the compartments 13*a* and down into the funnel-shaped catchment basin formed on the bottom 13*b* of the drawer housing 14.

The drawer flush circuit 15 is connected to the on-off valve 10 downstream of the water softening device 11, and is structured for spilling/pouring the fresh water arriving from the water softening device 11 selectively and alternatively into one or more of the detergent compartments 13*a* of detergent drawer 13.

With reference to FIGS. 6-9, in the example shown, in particular, the drawer flush circuit 15 preferably comprises:

a sprinkler head which associated to the drawer housing 14 so as to be located immediately above the detergent drawer 13 when the latter is completely inserted/recessed into the drawer housing 14, and which is provided with a number (three in the example shown) of shower-making portions/sections each of which is preferably substantially aligned to a corresponding detergent compartment 13*a* of the detergent drawer 13 and is structured for feeding a dense shower of water droplets by gravity into the detergent compartment 13*a* located immediately beneath; and preferably an electrically-controlled hydraulic distributor assembly 18 which is located immediately upstream of the sprinkler head, i.e. between the sprinkler head and the on-off valve 10, and is structured for channeling the fresh water arriving from the on-off valve 10 selectively and alternatively towards the various shower-making sections/portions of the sprinkler head.

More specifically, in the example shown, each shower-making section/portion of the sprinkler head is preferably vertically aligned to a respective detergent compartment 13*a* of the detergent drawer 13, and is structured for feeding a dense shower of water droplets exclusively into the detergent compartment 13*a* located immediately beneath.

Figure 6:
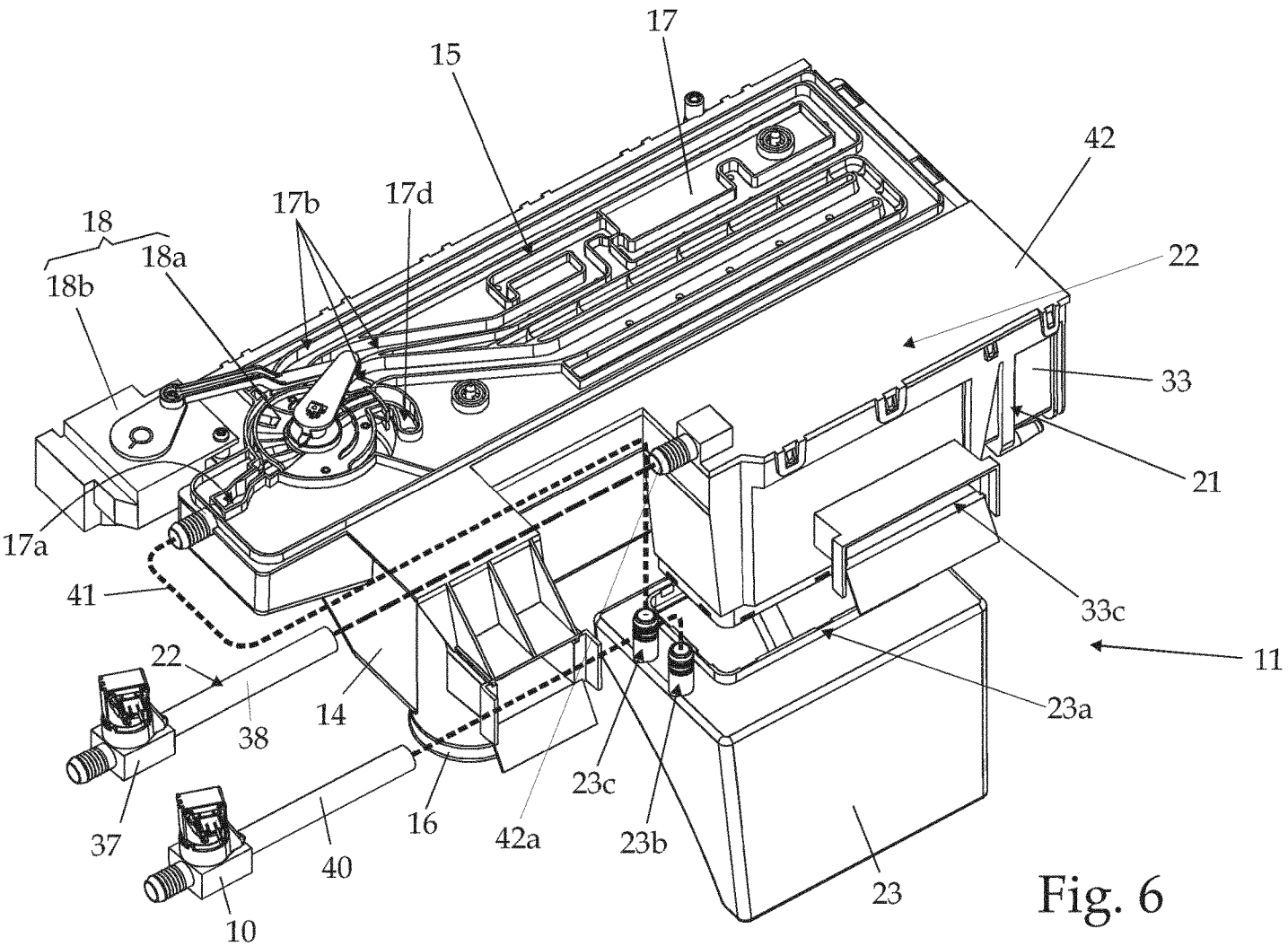
FIG. 6 is a perspective view of the internal detergent dispenser and internal water softening device of the FIG. 1 laundry washing machine.
Figure 7:
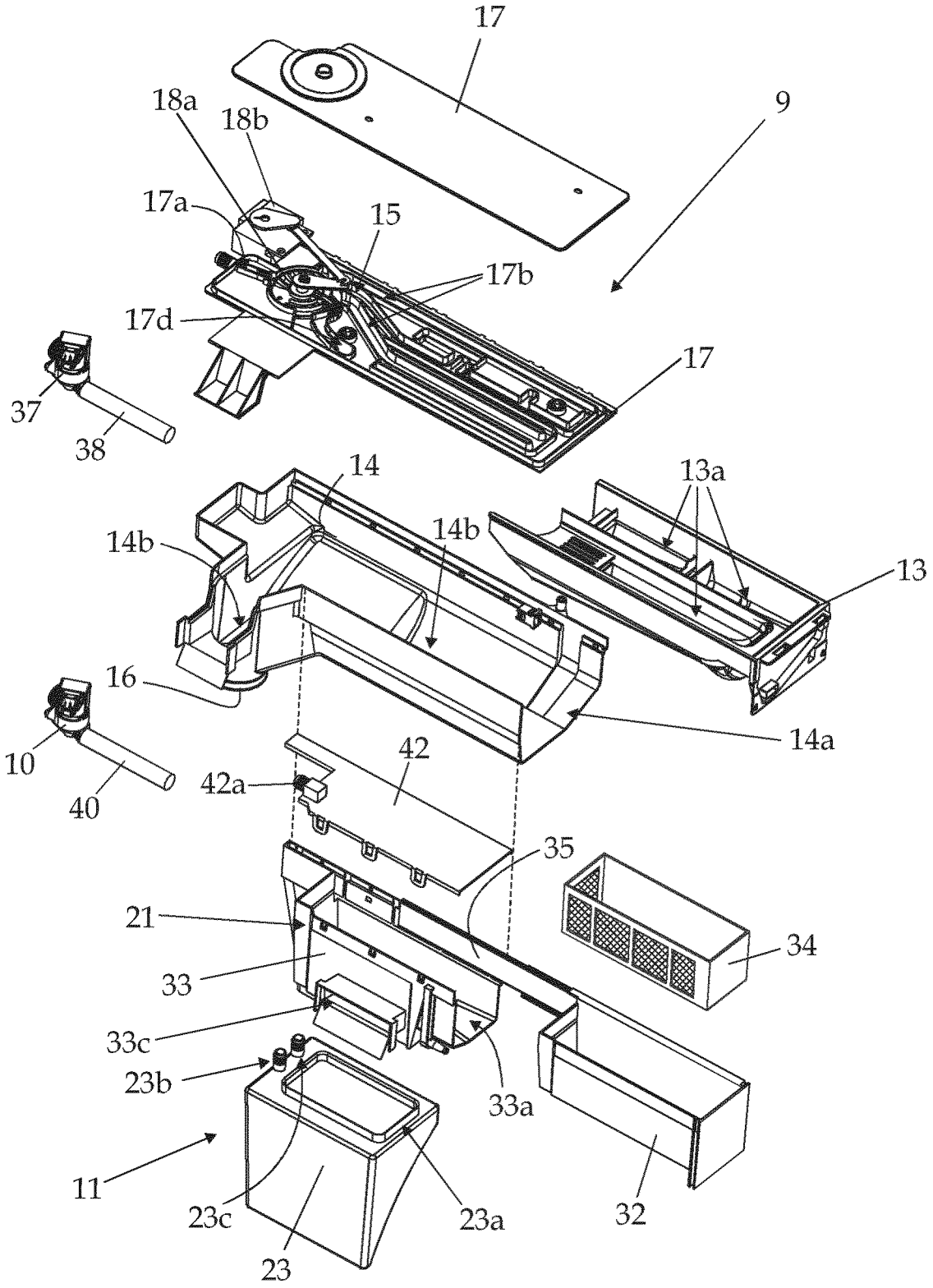
FIG. 7 is a partly-exploded perspective view of the internal detergent dispenser and internal water softening device shown in FIG. 6, with parts removed for clarity.
Figure 8:
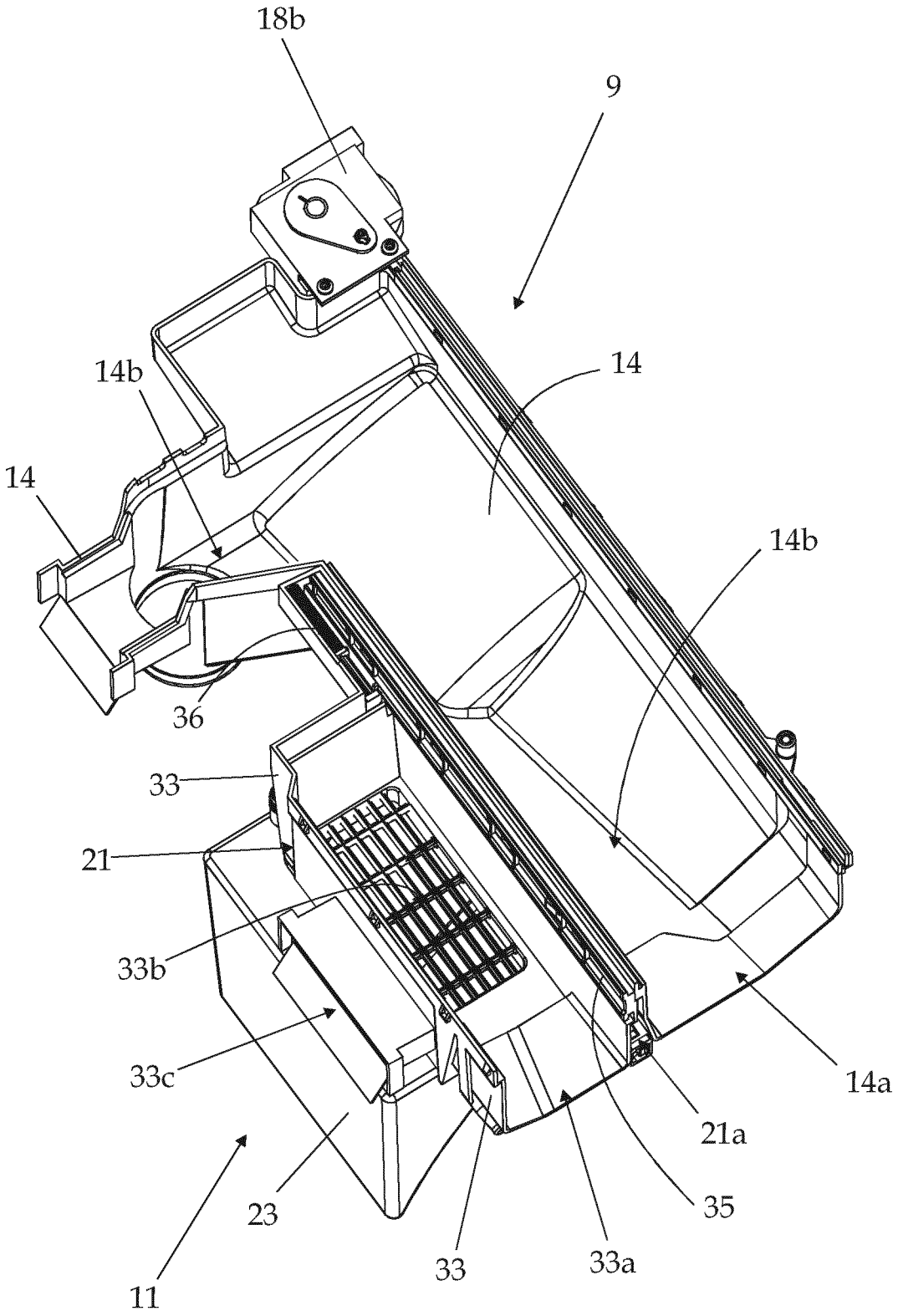
FIG. 8 is a perspective view of some component parts of the internal detergent dispenser and water softening device shown in FIGS. 6 and 7.

With reference to FIGS. 6, 7 and 8, in the example shown, in particular, the drawer housing 14 is preferably substantially basin-shaped, and the detergent dispenser 9 also comprises a preferably substantially flat, upper lid or cover 17 which is designed to close the top of the drawer housing 14 so to be located immediately above the detergent drawer 13 when the latter is completely inserted/recessed into the drawer housing 14. The detergent container housing of detergent dispenser 9 is therefore preferably formed by the basin-shaped drawer housing 14 and upper lid or cover 17.

The lid or cover 17 is furthermore preferably structured so as to incorporate the sprinkler head of the drawer flush circuit 15. In other words the lid or cover 17 on top of drawer housing 14 forms the sprinkler head of the drawer flush circuit 15 and is therefore divided into a number (three in the example shown) of shower-making portions, each of which is vertically aligned to a corresponding detergent compartment 13*a* of the detergent drawer 13, and is structured for receiving the fresh water from the hydraulic distributor assembly 18 and for feeding a dense shower of water droplets by gravity exclusively into the detergent compartment 13*a* located immediately beneath.

The hydraulic distributor assembly 18, instead, preferably comprises a rotatable water diverter 18*a* which is preferably recessed into the sprinkler lid or cover 17 in axially rotating manner; and an electric motor or other electrically-operated rotatable actuator 18*b* which is fixed sideways of the sprinkler lid or cover 17 and is mechanically connected to the central shaft of the rotatable water diverter 18*a* via a crank-rod mechanism, so to directly control/vary the angular position of the rotatable water diverter 18*a*.

Figure 9:
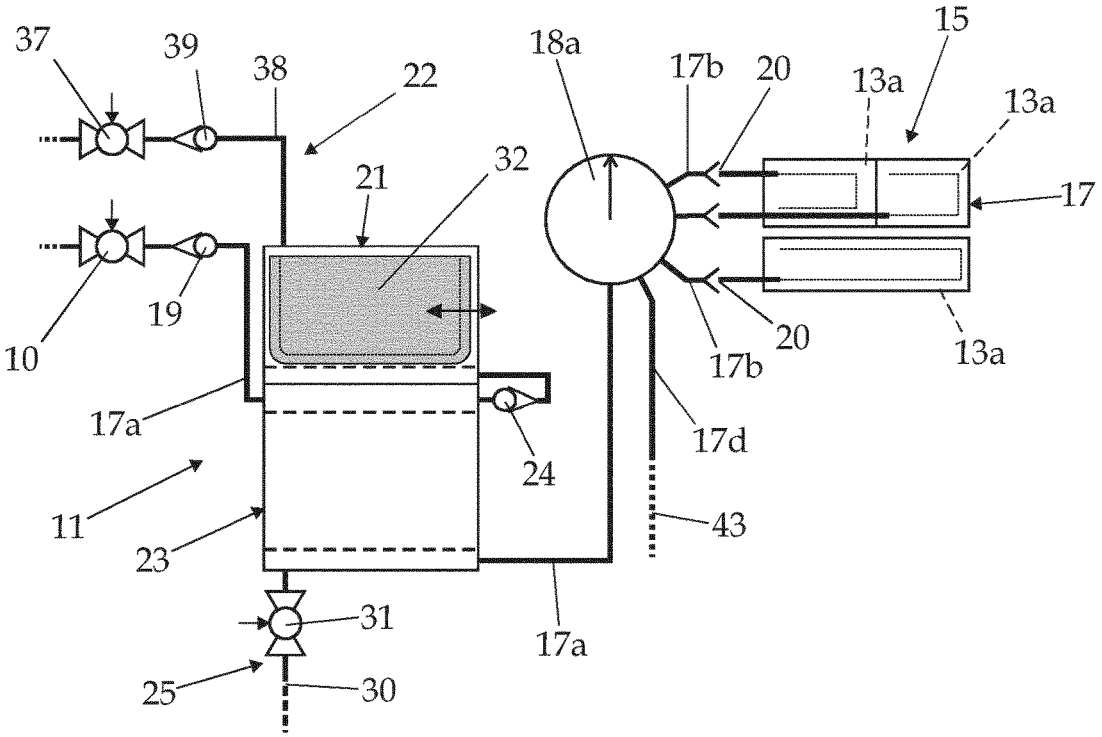
FIG. 9 is a schematic view of the FIG. 6 detergent dispenser and water softening device.

With reference to FIGS. 7 and 9, the sprinkler lid or cover 17 has a first internal water channel 17*a* that connects the inlet of the rotatable water diverter 18*a* to the on-off valve 10, so to channel fresh water to the inlet of the rotatable water diverter 18*a*; and a number of second water channels 17*b* each connecting a respective outlet of the rotatable water diverter 18*a* to a corresponding shower-making portion of the sprinkler lid or cover 17.

The fresh water from the water mains arrives to the inlet of the rotatable water diverter 18*a* and is selectively channeled/directed to one of the shower-making portions of the sprinkler lid or cover 17 according to the angular position of the rotatable water diverter 18*a*.

As an alternative, the electric motor 18*b* could be connected to the central shaft of the rotatable water diverter 18*a* via a driving belt winded on a couple of pulleys mortised one to the drive shaft of electric motor 18*b*, and the other to the central shaft of the rotatable water diverter 18*a*.

In a different non-shown embodiment, the hydraulic distributor assembly 18 formed by the rotatable water diverter 18*a* and the electric motor 18*b* may be replaced by a number of electrically-controlled on-off valves each of which is interposed between the on-off valve 10 and a respective shower-making section/portion of the sprinkler head 17 for directly controlling the flow of fresh water towards the corresponding shower-making section/portion of the sprinkler head 17.

With referenced to FIG. 9, preferably, though not necessarily, the drawer flush circuit 15 also comprises a one-way valve 19 which is located immediately downstream of the on-off valve 10, i.e. between the on-off valve 10 and the inlet of the rotatable water diverter 18*a*, and is structured to allow fresh water to only flow from the on-off valve 10 to the water diverter 18*a* of detergent dispenser 9 and not vice versa.

In addition the drawer flush circuit 15 is preferably also provided with a number of air-break assemblies 20 each located immediately downstream of a corresponding water outlet of the rotatable water diverter 18*a*, i.e. along a corresponding second water channel 17*b* of the sprinkler lid or cover 17.

With reference to FIGS. 4-9, the water softening device 11, in turn, is preferably inserted/located between the on-off valve 10, or the one-way valve 19 if present, and the inlet of the hydraulic distributor assembly 18 of the drawer flush circuit 15, so to be crossed by the fresh water flowing towards the hydraulic distributor assembly 18, and basically comprises: a water-softening agent container which is filled with a water softening agent able to reduce the hardness degree of the fresh water flowing through said water-softening agent container, and a regeneration-agent reservoir which is fluidly connected to said water-softening agent container and is structured for receiving a given quantity of salt or other regeneration agent and is able to regenerate the water softening function of the water softening agents.

Both the water-softening agent container and the regeneration-agent reservoir are housed inside the casing 2, and the regeneration-agent reservoir is moreover preferably arranged inside the casing 2, beside the detergent dispenser 9 in a direction locally substantially parallel to the front wall 2*a* of casing 2, so that both detergent dispenser 9 and the regeneration-agent reservoir of the water softening device 11 are directly exposed or exposable on the outside of boxlike casing 2, one beside the other, so to be preferably independently accessible by the user at any moment.

More specifically, the regeneration-agent reservoir of the water softening device 11 is housed inside the casing 2 between the detergent dispenser 9 and one of the side walls 2*b* of casing 2, and is provided with a second independent inlet which is exposed or exposable to the outside of the boxlike casing 2 beside the inlet of detergent dispenser 9. This second independent inlet is suitable for loading the salt or other regeneration agents inside the regeneration-agent reservoir.

In other words, the regeneration-agent reservoir of the water softening device 11 comprises a regeneration-agent container which is fillable with a given quantity of regeneration agents and is housed inside the casing 2 in a corresponding second housing or seat, and the front wall 2*a* of casing 2 is provided with a corresponding second pass-through opening through which the regeneration-agent container is accessible by the user.

In the example shown, in particular, this second independent inlet of the regeneration-agent reservoir of the water softening device 11 is preferably located on the front wall 2*a* of boxlike casing 2 immediately adjacent to the inlet of detergent dispenser 9.

With reference to FIGS. 1-5, in the example shown, in particular, the water softening device 11, and more specifically the regeneration-agent reservoir of the water softening device 11, is located inside the boxlike casing 2 preferably immediately beside the detergent dispenser 9, on the other side of the appliance control panel 12 that is arranged on the front wall 2*a* of casing 2 above the laundry loading/unloading opening and immediately beneath the top wall 2*d* of casing 2.

With reference to FIGS. 6-9, in the example shown, in particular, the water softening device 11 comprises:

an outside-accessible regeneration-agent reservoir 21 which is structured for receiving a given amount (for example half a Kilo or one Kilo) of salt grains (Sodium Chloride) or similar regeneration chemical agent, and is housed inside the boxlike casing 2 immediately beside the drawer housing 14 of detergent dispenser 9 in a direction substantially parallel to the front wall 2*a* of casing 2, so to emerge from a corresponding pass-through opening realized on the front wall 2*a* of the boxlike casing 2 immediately beside the entrance/front opening 14*a* of the drawer housing 14;

a water supply circuit 22 which is structured for selectively spilling/pouring, on command, a given amount of fresh water into the regeneration-agent reservoir 21 so to at least partly dissolve the salt stored therein and form a given amount of brine (i.e. salt water); and a water-softening agent container 23 which is filled with a given amount of ion-exchange resins (not shown) capable to restrain the calcium and/or magnesium ions (Ca++ an Mg++) dissolved in the fresh water flowing across the resin container 23, and which is interposed between the on-off valve 10, or the one-way valve 19 if present, and the detergent dispenser 9.

The resin container 23 is preferably interposed between the on-off valve 10, or the one-way valve 19 if present, and the inlet of the rotatable water diverter 18*a* of the drawer flush circuit 15 so to be crossed by the fresh water flowing from the on-off valve 10 to the hydraulic distributor assembly 18.

The water supply circuit 22 is therefore structured for spilling/pouring a given amount of fresh water into the regeneration-agent reservoir 21 of water softening device 11 to at least partly dissolve the salt or other regeneration agents stored therein.

The ion-exchange resins (not shown) stored into the resin container 23 instead form the water softening agents of the water softening device 11.

In the example shown, in particular, the resin container 23 is preferably located inside the casing 2, immediately beneath the regeneration-agent reservoir 21 and immediately beside the upper portion of washing tub 3, so as to internally face the front wall 2*a* of casing 2. Thus the resin container 23 is located below the drawer housing 14 of detergent dispenser 9.

The resin container 23 is preferably located within an approximately triangular pocket compartment or seat delimited by the sidewall 2*b* of the boxlike casing 2, the upper portion of the washing tub 3, the front wall 2*a* of casing 2, and the supply duct 16 connecting the drawer housing 14 to the washing tub 3.

With reference to FIG. 7, the resin container 23 is provided as a completely stand-alone cartridge or similar modular component-part 23 which is provided with a mechanical coupling interface 23*a* structured for allowing rigid fastening and fluidical connection of the stand-alone modular component-part 23 directly to the bottom of the regeneration-agent reservoir 21.

This stand-alone modular component-part 23 is furthermore provided with two hydraulic connectors 23*b*, 23*c* structured for allowing fluidical connection of the resin container 23 in series to the water supply line that channels the fresh water from the on-off valve 10 to the inlet of the hydraulic distributor assembly 18.

A first hydraulic connector 23*b* directly communicates with the on-off valve 10 so as to allow the inflow of the fresh water into the resin container 23, whereas a second hydraulic connector 23*c* directly communicates with the hydraulic distributor assembly 18 so as to allow the outflow of the fresh water from the resin container 23 towards the inlet of the rotatable water diverter 18*a*.

The ion-exchange resins (not shown) are preferably, though not necessarily, confined, inside the resin container 23, into a water-permeable basket (not shown) whose volume is less than that of the resin container 23 so as to form an internal peripheral gap or interspace allowing free fresh-water circulation.

With reference to FIGS. 6, 7 and 8, likewise resin container 23, also salt reservoir 21 is preferably provided as a stand-alone modular component-part 21 which is provided with mechanical coupling means 21*a* structured for allowing rigid fastening of the salt reservoir 21 to the side of detergent dispenser 9. Detergent dispenser 9, in turn, is preferably provided with complementary mechanical coupling means structured for engaging the mechanical coupling means 21*a* of salt reservoir 21.

In the example shown, mechanical coupling means 21*a* preferably consist in snap-on locking means structured for rigidly fastening the salt reservoir 21 to the side of the drawer housing 14 of detergent dispenser 9.

Thus the water softening device 10 comprises at least one stand-alone modular component-part 21, 23 which is structured for being rigidly connectable/attachable to the detergent dispenser 9, or preferably to the drawer housing 13 of detergent dispenser 9.

With reference to FIG. 9, the water softening device 11 furthermore comprises: a one-way valve 24 which is interposed between the regeneration-agent reservoir 21 and the resin container 23, and is structured to allow the brine contained in the regeneration-agent reservoir 21 to freely flow by gravity into the resin container 23, and to prevent the fresh water arriving into the resin container 23 from the on-off valve 10 to go up into the regeneration-agent reservoir 21; and preferably also water-hardness sensor means (not shown) structured to measure the hardness degree of the fresh water coming out from the resin container 23 directed towards the detergent dispenser 9.

In the example shown, in particular, the water-hardness sensor means are able to communicate with an internal electronic central control unit (not shown) which controls all electrically-operated component parts of the laundry washing machine 1, and is housed inside the boxlike casing 2, preferably on the back of control panel 12.

Preferably, though not necessarily, the water softening device 11 is finally provided with a water drain line 25 which is structured for selectively draining the brine or fresh water out of resin container 23 and preferably channeling said brine or fresh water directly into the washing tub 3, into the drain sump 26 that extends downwards form the bottom of the washing tub 3, or into the water filtering assembly 27 that is interposed between the drain sump 26 of washing tub 3 and the suction of the water circulating pump 28 and of the water exhaust pump 29 which, in the example shown, are both preferably located on the bottom of the boxlike casing 2, or substantially directly into the water exhaust pump 29 which drains water or washing liquor outside the machine.

In the example shown, in particular, the water drain line 25 preferably comprises an exhaust duct 30 which directly connects the bottom of the resin container 23 either to the washing tub 3, to the drain sump 26 or to the water filtering assembly 27, or to water exhaust pump 29; and an electrically-controlled on-off valve 31 which is located along the exhaust duct 30 for controlling the outflow of the brine or fresh water from the resin container 23.

With reference to FIGS. 5-9, the regeneration-agent reservoir 21 preferably comprises a salt drawer 32 which is inserted in manually extractable manner into a second drawer housing or seat 33 which extends substantially horizontally inside the boxlike casing 2, immediately beside the drawer housing 14 of detergent dispenser 9, starting from a pass-through front entrance or opening 33*a* which is realized on the front wall 2*a* of casing 2 locally adjacent to the entrance/front opening 14*a* of the drawer housing 14 of detergent dispenser 9.

The salt drawer 32 of regeneration-agent reservoir 21 is therefore movable inside the drawer housing or seat 33 so as to be at least partly extractable from the drawer housing or seat 33 through the front entrance or opening 33*a* on the front wall 2*a* of casing 2.

The displacement direction of the salt drawer 32 is furthermore preferably locally substantially parallel to the displacement direction of detergent drawer 13, thus detergent drawer 13 and salt drawer 32 are able to jut out from the front wall 2*a* of casing 2 while remaining locally substantially parallel to one another.

With reference to FIG. 8, the snap-on locking means 21*a* of salt reservoir 21 are preferably arranged on the lateral wall of drawer housing 33 so to allow quick and rigid fastening of the drawer housings 14 and 33 to one another.

In addition to the above, in the example shown the front panel 13*f* of the detergent drawer 13 is preferably substantially handle-shaped and is preferably dimensioned so to completely cover, when the detergent drawer 13 is completely inserted into the drawer housing 14, both the entrance/front opening 14*a* of drawer housing 14 and the entrance/front opening 33*a* of drawer housing 33, so to completely hide both the detergent dispenser 9 and the water softening device 11.

The water supply circuit 22 of the water softening device 11 is structured for spilling/pouring the fresh water directly into the salt drawer 32 when the latter is completely inserted into its drawer housing 33, and reservoir 21 preferably also comprises a substantially basin-shaped, water-permeable salt basket 34 which is fitted/recessed into the salt drawer 32 preferably in manually-removable manner, and is dimensioned for being manually fillable with said given amount of salt grains or other water-softening chemical agent.

Figure 5:
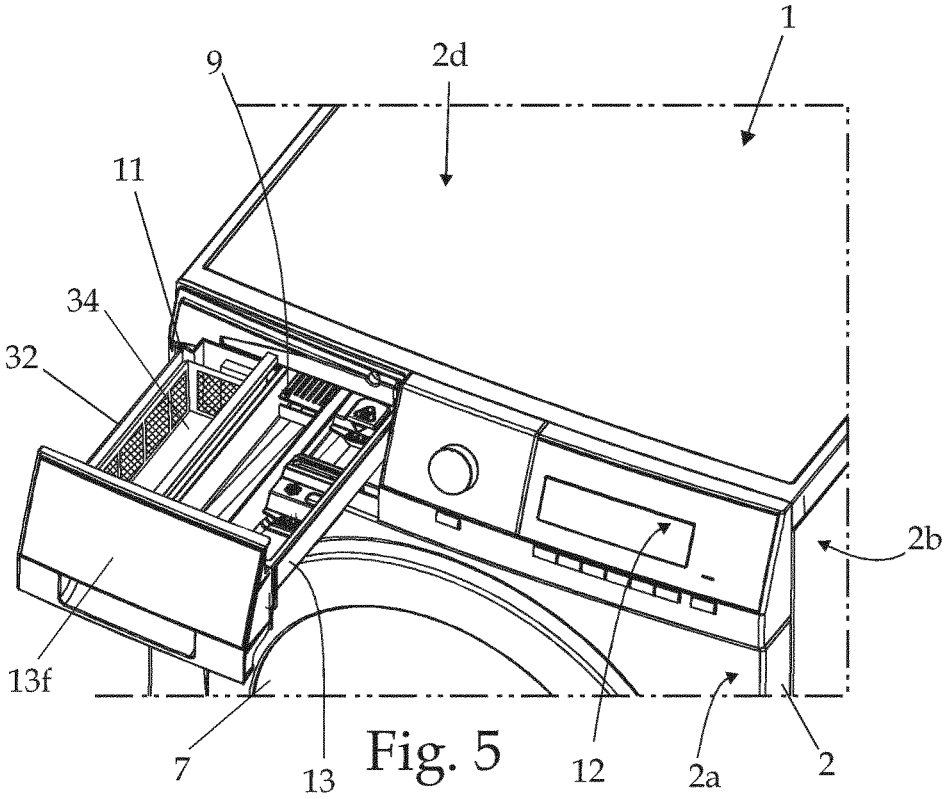
FIG. 5 is a perspective view of the top portion of the FIG. 1 laundry washing machine in a second operating position.

With reference to FIGS. 5 and 7, in the example shown, in particular, the bottom and/or at least one of sidewalls of the salt basket 34 have a meshed structure so as to allow the fresh water spilled/poured into the salt drawer 32 to freely reach and at least partly dissolve the salt grains located inside the salt basket 34 to form a give amount of brine which is subsequently drained into the drawer housing 33 via a siphons assembly or discharge hopper or opening (not shown) incorporated in the salt drawer 32.

The brine accumulated on the bottom of the drawer housing 33, in turn, is subsequently drained/channeled into the resin container 23 via the one-way valve 24, when the hydrostatic pressure inside the resin container 23 allows the brine to flow by gravity within the resin container 23.

With reference to FIGS. 7 and 8, in the example shown, in particular, the drawer housing 33 of regeneration-agent reservoir 21 is preferably substantially basin-shaped similarly to drawer housing 14, and the snap-on locking means 21*a* are preferably arranged on the sidewall of the basin-shaped drawer housing 33 that is directly faced the drawer housing 14 of detergent dispenser 9.

Furthermore, the bottom 33*b* of the drawer housing 33 is preferably shaped so as to form a funnel-shaped catchment basin 33*b* that directly communicates with the inside of resin container 23 via a large pass-through opening into which the one-way valve 24 is preferably recessed. This pass-through opening is preferably upwardly closed by a protective grid which is dimensioned to prevent the salt grains from reaching and blocking the one-way valve 24.

With reference to FIG. 7, the mechanical coupling interface 23*a* of the resin container 23, in turn, is preferably provided with an outwards-projecting connecting sleeve or manifold which is structured/dimensioned to couple in watertight manner with the pass-through opening on the bottom 33*b* of drawer housing 33, so as to put the inside of resin container 23 in direct communication with the drawer housing 33 via the one-way valve 24.

As an alternative the one-way valve 24 may be recessed into the connecting sleeve or manifold 23*a* that protrudes upwards from the resin container 23.

With reference to FIGS. 7 and 8, the drawer housing 33 is preferably, though not necessarily, finally provided with a discharge hopper or opening 33*c* which is preferably located on a lateral wall of the drawer housing 33 and is structured to drain out of the funnel-shaped catchment basin 33*b* the brine that exceeds a predetermined maximum level.

With reference to FIGS. 7 and 8, the salt drawer 32, in turn, is preferably fixed to/supported by a longitudinal rail or telescopic runner 35 that is arranged into the drawer housing 33 locally substantially parallel to the preferably substantially horizontally-oriented insertion and extraction direction of the salt drawer 32, so as to allow the manual displacement of the salt drawer 32 in and out of the drawer housing 33. Preferably a push-pull mechanism 36 is also arranged into the drawer housing 33 to ease the manual insertion and extraction of salt drawer 32.

With reference to FIGS. 6 and 7, the water supply circuit 22 of water softening device 11 instead comprises an additional electrically-controlled on-off valve 37 which is interposed between the water mains and the regeneration-agent reservoir 21 and, similarly to on-off valve 10, is able to control/regulate the flow of fresh water towards the regeneration-agent reservoir 21; and an internal water channel which extends inside the drawer housing 33 and is fluidly connected to the salt drawer 32 so to channel the fresh water arriving from the on-off valve 37 directly into the salt drawer 32.

In the example shown, the water supply circuit 22 furthermore comprises a hosepipe 38 connecting the on-off valve 37 to the internal water channel (not shown) on drawer housing 33.

Likewise to the drawer flush circuit 15, the water supply circuit 22 is preferably also provided with a corresponding one-way valve 39 which is located immediately downstream of the on-off valve 37, i.e. between the on-off valve 37 and the internal water channel of drawer housing 33, and is structured to allow fresh water to only flow from the on-off valve 37 to the internal water channel of drawer housing 33 and not vice versa.

The water softening device 11 preferably comprises a first hosepipe 40 directly connecting the on-off valve 10 to the hydraulic connector 23*b* of the resin container 23, and a second hosepipe 41 directly connecting the hydraulic connector 23*c* of the resin container 23 to the inlet of the internal water channel 17*a* of the sprinkler lid or cover 17.

With reference to FIGS. 6 and 7, in the example shown, in particular, the drawer housing 33 is substantially basin-shaped and the regeneration-agent reservoir 21 also comprises a preferably substantially flat lid or cover 42 which is designed to close exclusively the top of the basin-shaped drawer housing 33, so to be located immediately above the salt drawer 32 when the latter is completely inserted/recessed into the drawer housing 33. This lid or cover 42 furthermore is preferably arranged locally adjacent to the flat lid or cover 17 of detergent drawer 9.

The housing of the regeneration-agent container of water softening device 11 is therefore preferably formed by the basin-shaped drawer housing 33 and the corresponding upper lid or cover 42.

The internal water channel 42*a* of the water supply circuit 22 is preferably realized/integrated into the lid or cover 42.

With reference to FIG. 9, in the example shown, the drawer flush circuit 15 preferably also comprises an auxiliary second water drain line 43 that branches off from a corresponding outlet of the hydraulic distributor assembly 18, and is structured for channeling the brine or fresh water arriving from the resin container 23 preferably, though not necessarily, directly into the washing tub 3, or into the drain sump 26, or into the water filtering assembly 27, or into pump 29.

In other words, one of the outlets of the rotatable water diverter 18*a* of drawer flush circuit 15 is preferably connected to an auxiliary water drain line 43 which preferably, though not necessarily, ends into the washing tub 3 or into the drain sump 26 or into the water filtering assembly 27, or into pump 29; and the electric motor 18*b* is preferably structured to selectively place/arrange the rotatable water diverter 18*a* in a position that allows to channel the brine or fresh water arriving from the resin container 23 to the auxiliary water drain line 43 that, in turn, channels said brine or fresh water directly into the washing tub 3 or into the drain sump 26 or into the water filtering assembly 27, or into pump 29.

Like water drain line 25, the auxiliary water drain line 43 of drawer flush circuit 15 allows to selectively channel/drain out of the resin container 23 the brine or fresh water that fills said resin container.

With reference to FIGS. 6 and 9, in the example shown, in particular, the sprinkler lid or cover 17 preferably comprises a fourth internal water channel 17*d* which extends inside the sprinkler lid or cover 17 from a corresponding outlet of the rotatable water diverter 18*a* of the drawer flush circuit 15 to the inlet of an auxiliary hosepipe 43 that extends towards the bottom of the boxlike casing 2 and ends directly into the washing tub 3 or into the drain sump 26 or into the water filtering assembly 27 or into the exhaust pump 29.

Preferably to the auxiliary water drain line 43 may also comprise an air-break assembly (not shown) arranged along the fourth internal water channel 17*d* of the sprinkler lid or cover 17.

General operation of home laundry washing machine 1 is clearly inferable from the above description. When the on-off valve 10 is opened the fresh water flows from the water mains to the hydraulic distributor assembly 18 of the drawer flush circuit 15 that, according to the washing cycle, channels said fresh water to one of the shower-making sections/portions of the sprinkler lid or cover 17 for flushing the detergent, softener or other washing agent out of the corresponding detergent compartment 13*a* of the detergent drawer 13 and down into the washing tub 3 via the supply duct 16.

While flowing towards the drawer flush circuit 15, the fresh water flows through the resin container 23 wherein the ion-exchange resins reduce the hardness degree of the fresh water directed to the detergent drawer 13. The water-hardness sensor means monitor the hardness degree of the fresh water directed to the hydraulic distributor assembly 18 of the drawer flush circuit 15.

When it determines that the ion-exchange resins inside the resin container 23 are no longer able to reduce the hardness degree of the fresh water directed to the detergent drawer 13, the electronic central control unit (not shown) of the laundry washing machine 1 performs, preferably immediately before the starting of the rinsing phase of the washing cycle (i.e. during the washing phase of the washing cycle), a regeneration process of the ion-exchange resins stored inside the resin container 23. Obviously the regeneration process may also take place during the rinsing phase of the washing cycle.

During this regeneration process, the central control unit momentarily opens the on-off valve 37 so as to channel a given amount of fresh water into the regeneration-agent reservoir 21 via the water supply circuit 22.

When a sufficient amount of brine is formed inside the regeneration-agent reservoir 21, the central control unit arranges the hydraulic distributor assembly 18 so as to put the resin container 23 in direct communication with the auxiliary water drain line 43, and more or less at the same time it opens the on-off valve 31 of the water drain line 25 so as to drain the fresh water out of the resin container 23. Since at that time the on-off valve 10 is closed, the drainage of the fresh water from the resin container 23 causes the drop of the hydrostatic pressure inside the resin container 23 and the consequent automatic opening of the one-way valve 24 that allows the brine to flow by gravity into the resin container 23, thus replacing the fresh water previously store therein.

The fresh water previously store in the resin container 23, instead, flows directly into the washing tub 3 or into the drain sump 26 or into the water filtering assembly 27, into pump 29, via the water drain line 25 and/or via the auxiliary water drain line 43.

When brine has completely filled the resin container 23 in place of the fresh water previously store therein, the central control unit closes the on-off valve 31 of the water drain line 25 to restrain the brine inside the resin container 23 for a predetermined time interval generally sufficient to allow the brine to remove from the ion-exchange resins the calcium and magnesium ions previously combined/fixed to said resins.

Since in the example shown the rotatable water diverter 18*a* of drawer flush circuit 15 is located higher than the resin container 23 and the brine inside the resin container 23 is at ambient pressure, there is no need for the electronic central control unit of the laundry washing machine 1 to change configuration of the rotatable water diverter 18*a* to prevent the brine from coming out of the resin container 23 via the auxiliary water drain line 43.

After the resin-regeneration interval has lapsed, the central control unit opens again the on-off valve 31 of the water drain line 25 to drain the brine out of the resin container 23 and, more or less at the same time, opens again the on-off valve 10 so that the pressurized fresh water of the water mains pushes the brine away from the resin container 23 and into either the washing tub 3 or the drain sump 26 or the water filtering assembly 27 or pump 29, via the water drain line 25 and/or via the auxiliary water drain line 43.

Finally, preferably after having closed again the on-off valves 10 and 31, the central control unit of the laundry washing machine activates the water exhaust pump 29 so to discharge the brine out of the laundry washing machine 1 preferably together with the washing or rinsing water already stored on the bottom of the washing tub 3, and continues the washing cycle.

In a less sophisticated embodiment, however, the electronic central control unit of the laundry washing machine 1 may be programmed to regenerate the ion-exchange resins stored in the resin container 23 after a given number of washing cycles. In which case the water-hardness sensor means monitor are therefore unnecessary.

This number of washing cycles may be decided by the user on the basis of an alleged hardness degree of the fresh water coming out from the water mains.

The advantages resulting from the arrangement of the outside-accessible regeneration-agent reservoir 21 immediately beside the detergent dispenser 9 are remarkable.

First of all, the side by side modular structure of detergent dispenser 9 and water softening device 11 greatly simples the structure of detergent dispenser 9 with the consequent reduction of the detergent-dispenser overall production costs.

Furthermore the regeneration-agent reservoir 21 is directly accessible by the user on the front wall 2*a* of the boxlike casing 2, beside the detergent dispenser 9, thus greatly simplifying the manual loading of the salt grains into the regeneration-agent reservoir 21.

Last but not less important, the brine is no more allowed to reach the revolving drum, thus avoiding the rusting up of this component part.

Clearly, changes may be made to the front-loading laundry washing machine 1 as described above without, however, departing from the scope of the present invention.

Figure 11:
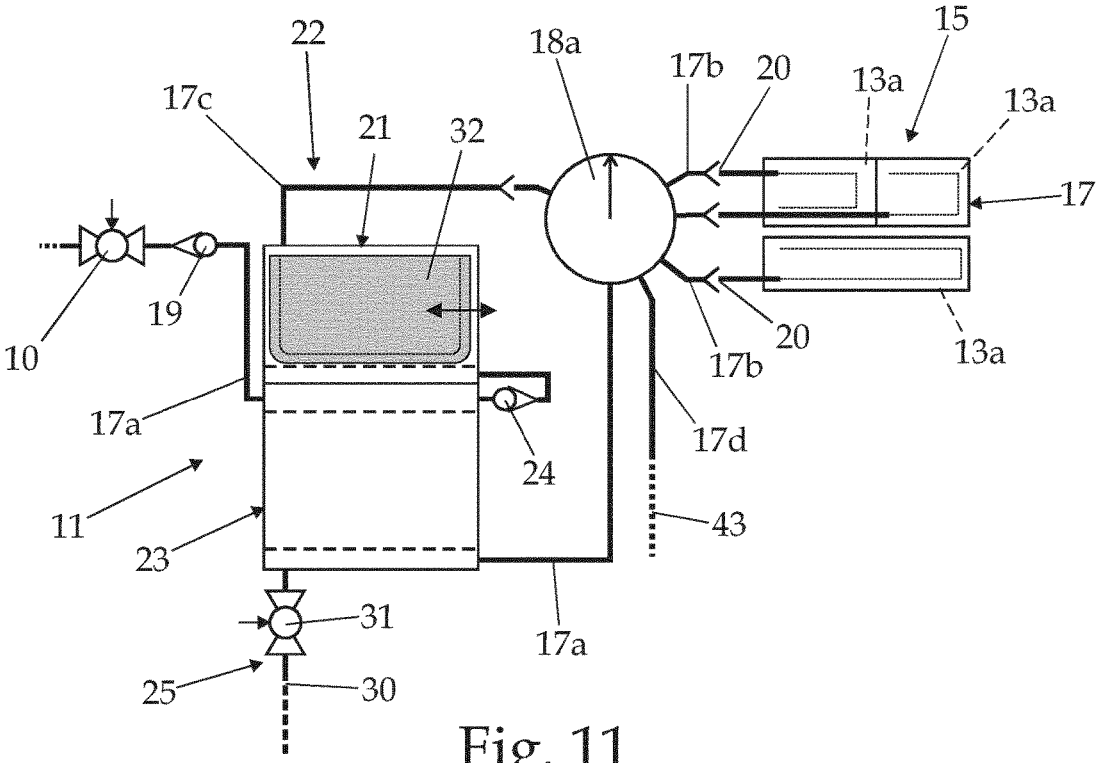
FIG. 11 is a schematic view of the FIG. 10 alternative embodiment of the internal detergent dispenser and water softening device of the FIG. 6 laundry washing machine.
Figure 10:
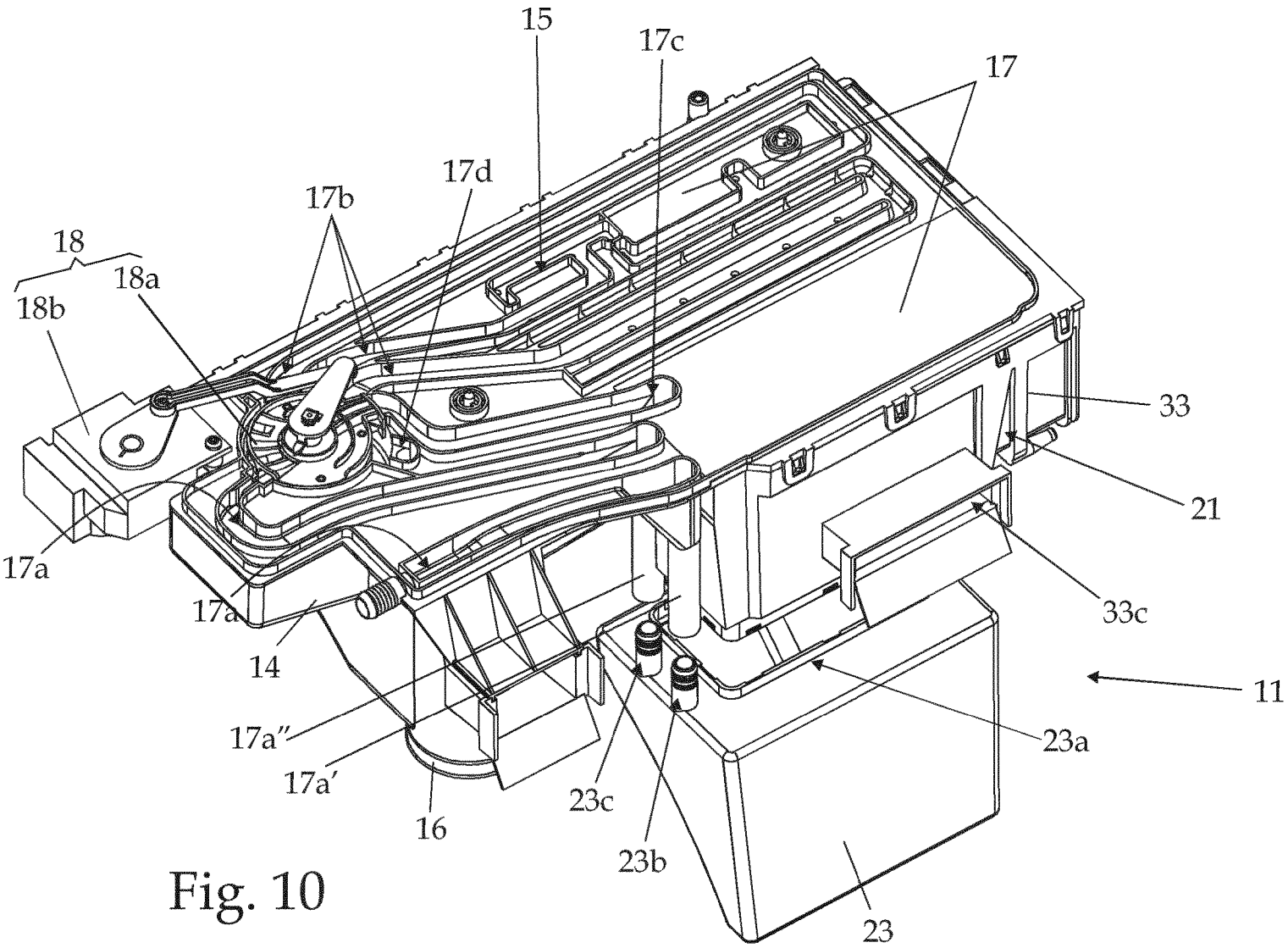
FIG. 10 is a perspective view of an alternative embodiment of the internal detergent dispenser and internal water softening device schematically shown in FIG. 6, with parts removed for clarity.

For example, with reference to FIGS. 10 and 11, in a much more sophisticated embodiment, the water softening device 11 lacks the on-off valve 37, the one-way valve 39 and the lid or cover 42; and the sprinkler lid or cover 17 of detergent dispenser 9 is shaped/designed to additionally completely close also the top of drawer housing 33.

In other words the sprinkler lid or cover 17 closes both drawer housings 14 and 33, and the drawer housing 33 of salt reservoir 21 is structured for being modularly connected to drawer housing 14 of detergent dispenser 9 and/or to the large lid or cover 17 of detergent dispenser 9. Thus the mechanical coupling means 21*a* are structured for allowing rigid fastening of the salt reservoir 21 to the sidewall of drawer housing 14 and/or to the sprinkler lid or cover 17 of detergent dispenser 9.

Furthermore the sprinkler lid or cover 17 preferably also incorporates the water supply circuit 22 of water softening device 11.

With reference to FIGS. 10 and 11, in particular, the water supply circuit 22 of water softening device 11 preferably branches off from the drawer flush circuit 15 of detergent dispenser 9.

More specifically, in this embodiment the sprinkler lid or cover 17 that closes both drawer housings 14 and 33 is preferably provided with a third internal water channel 17*c* which extends inside the sprinkler lid or cover 17 from a corresponding outlet of the rotatable water diverter 18*a* of the drawer flush circuit 15 and is fluidly connected to the salt drawer 32 so to channel the fresh water coming out of the rotatable water diverter 18*a* directly into the salt drawer 32.

The electric motor 18*b* of drawer flush circuit 15, in turn, is preferably structured to selectively place/arrange the rotatable water diverter 18*a* in a position that allows, when the brine is requested, to channel the fresh water arriving from the resin container 23 to the third internal water channel 17*c* of the sprinkler lid or cover 17.

In other words, the water supply circuit 22 comprises a water channel 17*c* that branches off from a corresponding outlet of the water diverter 18*a* and is fluidly connected to the salt drawer 32, so as to feed water to the regeneration-agent reservoir 21 under control of the hydraulic distributor assembly 18.

Moreover in this embodiment the internal water channel 17*a* of sprinkler lid or cover 17 receives the fresh water directly from the on-off valve 10, and the resin container 23 is preferably inserted/arranged along the internal water channel 17*a* that, inside the sprinkler lid or cover 17, channels the fresh water towards the inlet of the rotatable water diverter 18*a*. Thus the first and second hydraulic connectors 23*b* and 23*c* of resin container 23 are preferably structured for being connectable to the sprinkler lid or cover 17, along the internal water channel 17*a* of the lid or cover 17.

With reference to FIG. 10, in particular, in this embodiment the sprinkler lid or cover 17 is preferably provided with two tubular appendixes 17*a*' and 17*a*" that extend downwards, beside the drawer housing 33, up to reach and connect to the hydraulic connectors 23*b* and 23*c* of the resin container 23 located beneath the drawer housing 33. The tubular appendix 17*a*' connected to the hydraulic connector 23*b* forms the end portion of a first section of the internal water channel 17*a* directly communicating with the on-off valve 10; the tubular appendix 17*a*" connected to the hydraulic connector 23*c* forms the starting portion of a second section of the internal water channel 17*a* directly communicating with the inlet of the rotatable water diverter 18*a*.

Figure 12:
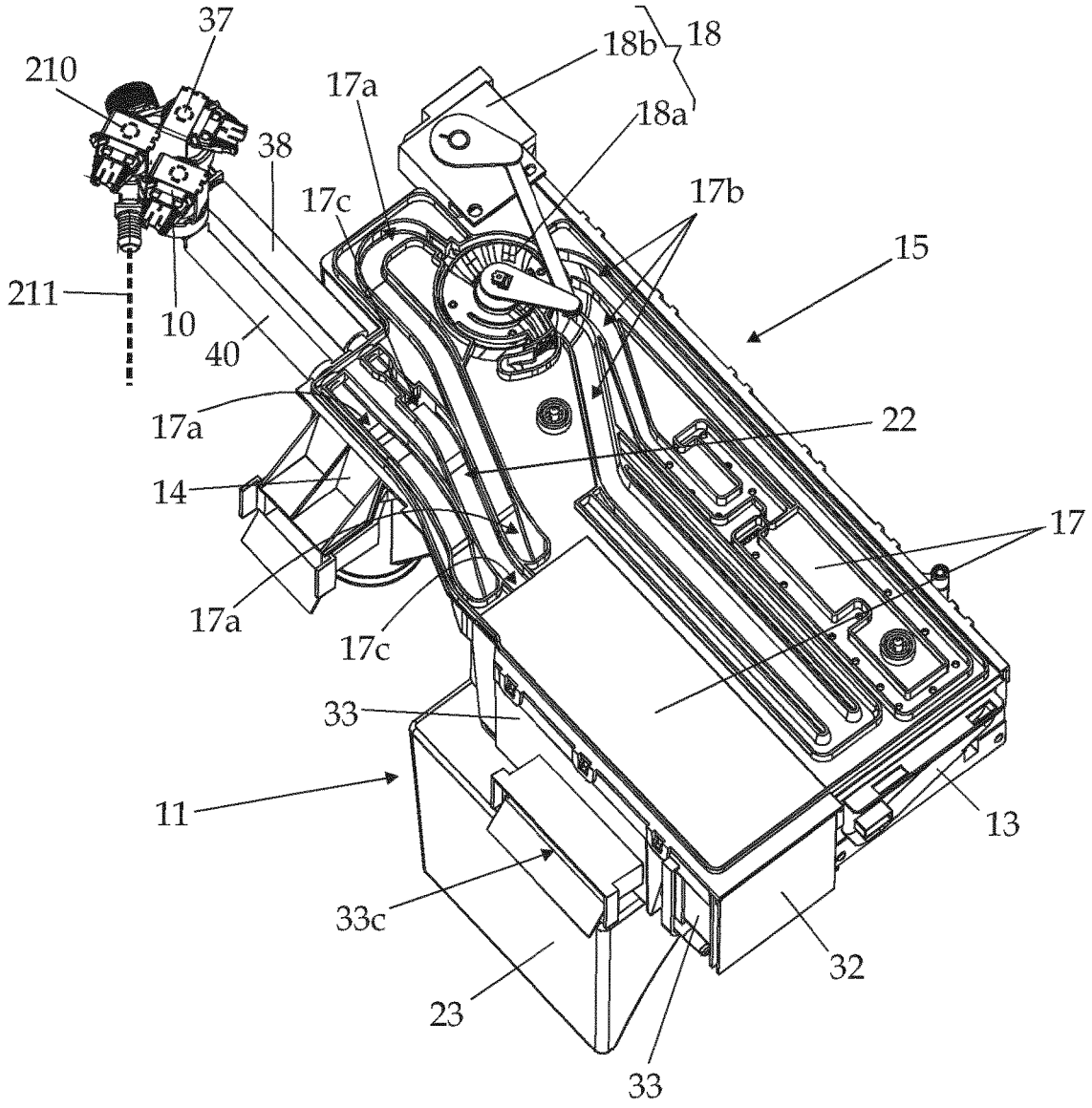
FIG. 12 is a perspective view of a second alternative embodiment of the internal detergent dispenser and internal water softening device shown in FIG. 6, with parts removed for clarity.

With reference to FIG. 12, instead, in a less sophisticated embodiment of the water supply circuit 22, the sprinkler lid or cover 17 of detergent dispenser 9 still closes both drawer housings 14 and 33, but the internal water channel 17*c* of the sprinkler lid or cover 17, rather than communicating with an auxiliary outlet of the rotatable water diverter 18*a* of the drawer flush circuit 15, is again directly connected to the electrically-controlled on-off valve 37 which controls/regulates the flow of fresh water towards the internal water channel 17*c* of the sprinkler lid or cover 17.

In the example shown, in particular, on-off valve 10 and on-off valve 37 are preferably integrated into a valve assembly that comprises a third electrically-controlled on-off valve 210 that is connected to a hosepipe 211 that ends into the washing tub 3. This third on-off valve is able to control/regulate the flow of fresh water from the water mains directly to the washing tub 3 bypassing the detergent drawer 9 and the waters softening device 11.

Figure 13:
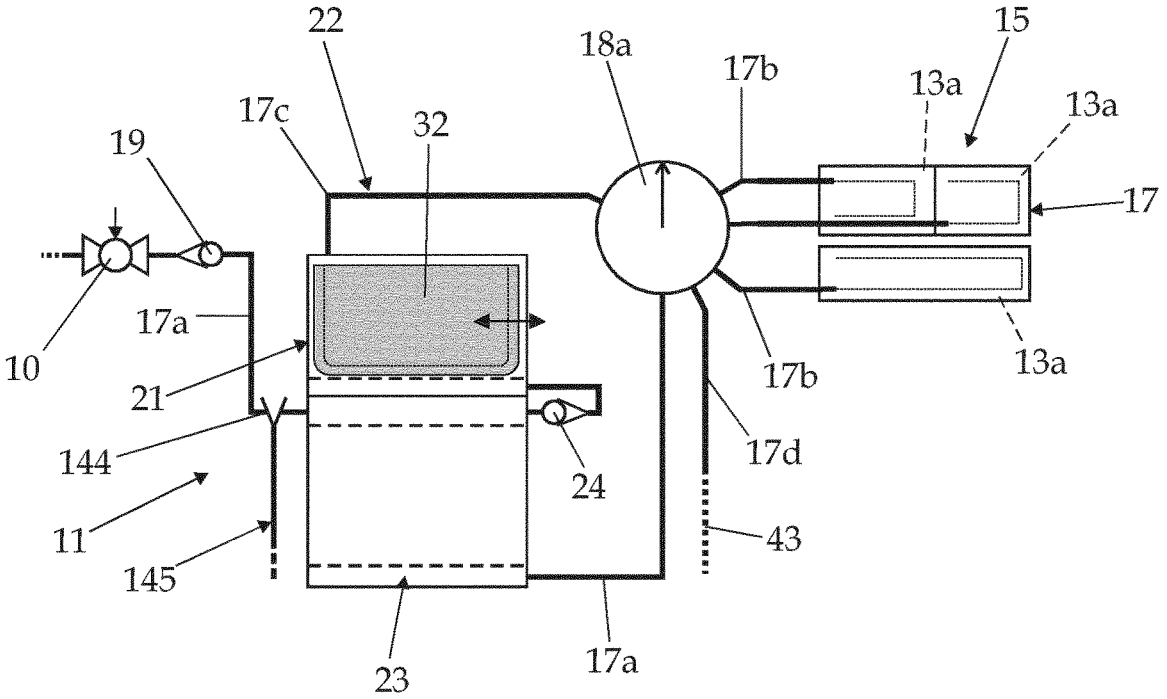
FIGS. 13 and 14 are respective schematic views of further alternative embodiments of the internal detergent dispenser and water softening device of the FIG. 1 laundry washing machine.

With reference to FIG. 13, instead, the water softening device 11 lacks the water drain line 25, whereas the drawer flush circuit 15 of detergent dispenser 9 lacks the air-break assemblies 20 located along the internal water channels 17*b*, 17*c* and 17*d* of the sprinkler lid or cover 17 and instead comprises an air-break assembly 144 which is located along the internal water channel 17*a* of the sprinkler lid or cover 17, immediately upstream of the resin container 23, and preferably integrates a discharge hopper which, in turn, communicates with either the washing tub 3, the drain sump 26, the water filtering assembly 27 or pump 29, via a specific water drain line 145. Thus the fresh water or brine exceeding the nominal capacity of the resin container 23 is allowed to come out from the resin container 23 via the air-break assembly 144 and be channeled directly into the washing tub 3 or into the drain sump 26 or into the water filtering assembly 27 or into pump 29 by the water drain line 145.

Figure 14:
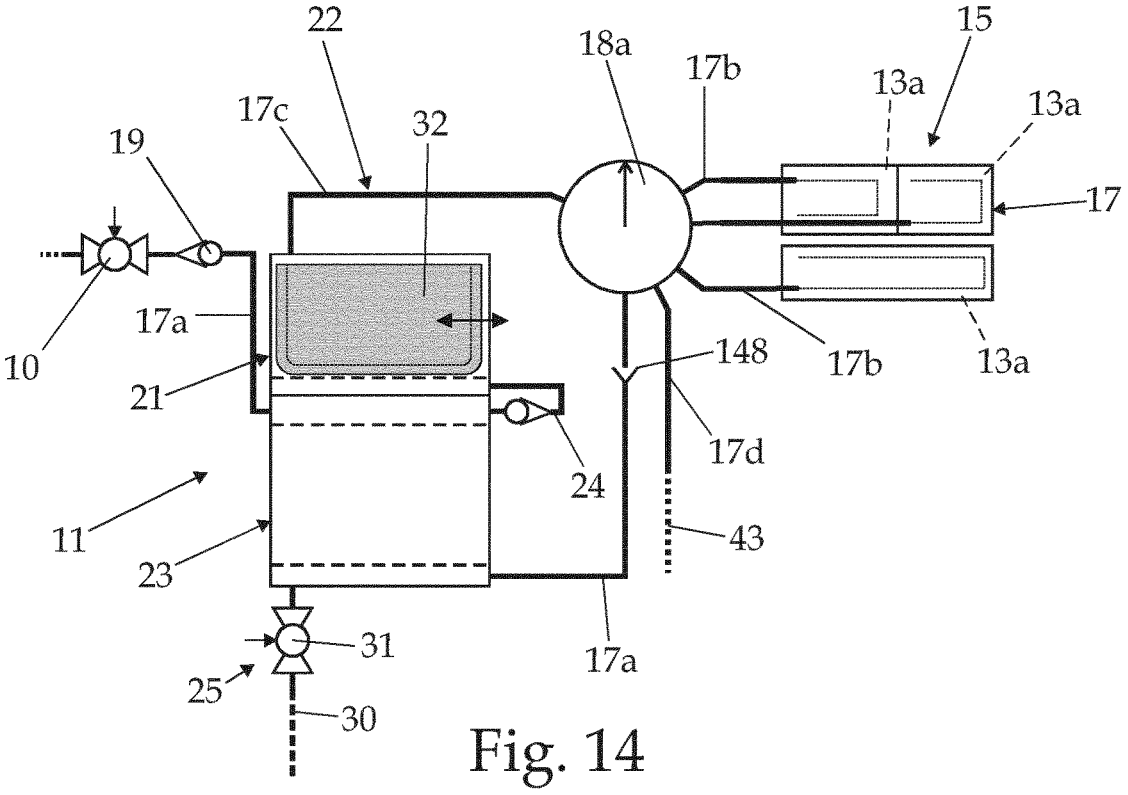

With reference to FIG. 14, instead, the drawer flush circuit 15 of detergent dispenser 9 lacks the air-break assemblies 20 located along the internal water channels 17*b*, 17*c* and 17*d* of the sprinkler lid or cover 17, and instead comprises a single air-break assembly 148 which is located along the internal water channel 17*a* of the sprinkler lid or cover 17, immediately upstream of the inlet of the rotatable water diverter 18*a*.

Figure 15:
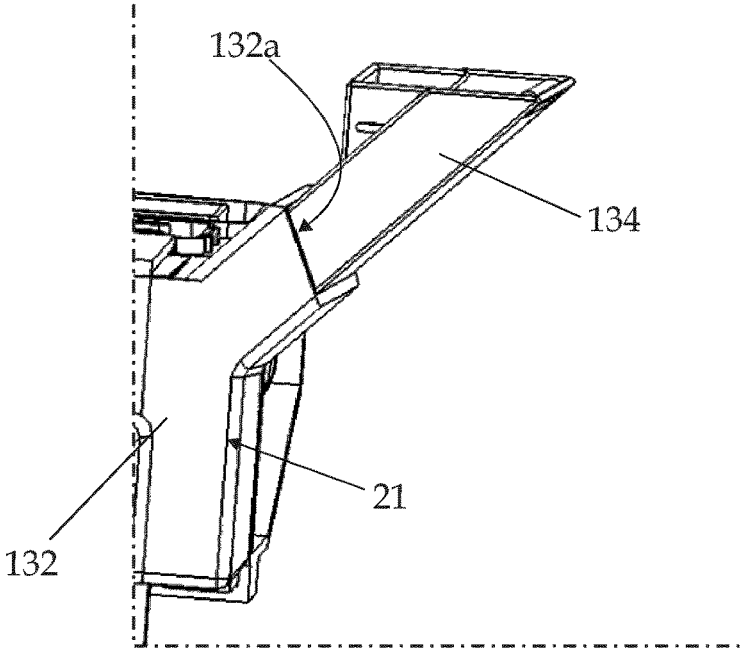
FIG. 15 shows a perspective view of a further alternative embodiment of the internal water softening device of the FIG. 1 laundry washing machine, with parts in section and parts removed for clarity.
Figure 16:
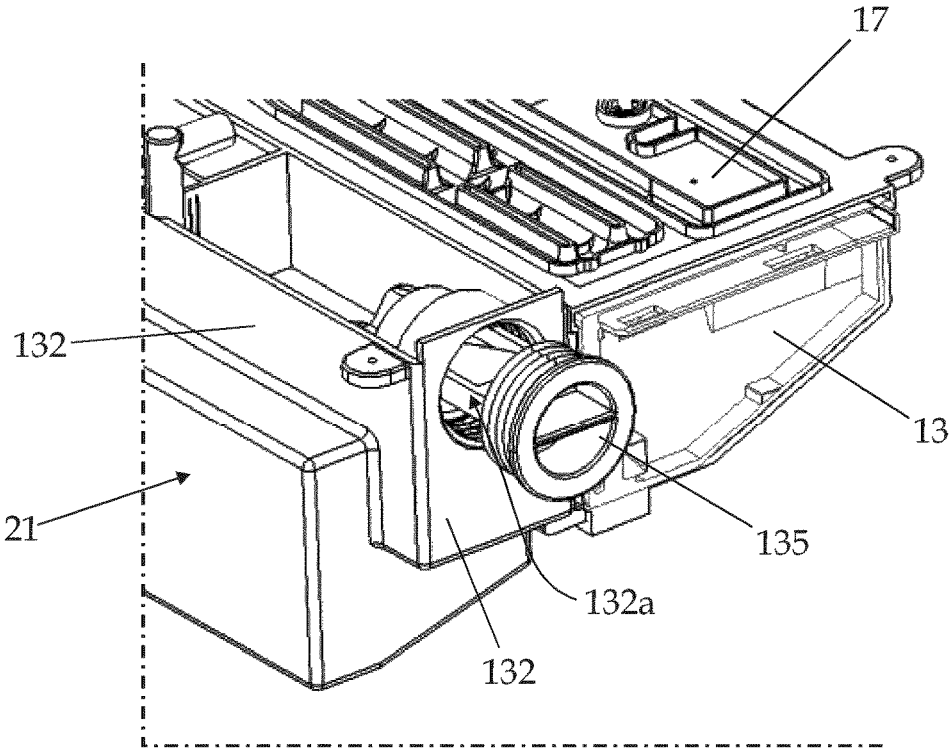

With reference to FIGS. 15 and 16, instead, the regeneration-agent reservoir 21 of the water softening device 11 may comprise a stand-alone modular salt container 132 which is permanently recessed/confined into a seat inside the boxlike casing 2, immediately beside the drawer housing or seat 14 of detergent dispenser 9. The stand-alone salt container 132 comprises mechanical coupling means (not shown) structured for allowing rigid fastening of the salt reservoir 132 to the side of detergent dispenser 9, and is furthermore provided with a salt-loading mouth 132*a* which is aligned to and engages a corresponding pass-through opening realized on the front wall 2*a* of casing 2, immediately beside the entrance/front opening 14*a* of the drawer housing 14, so that the salt-loading mouth 132*a* is exposed or exposable onto the front wall 2*a* of cabinet 2.

In the FIG. 15 embodiment, the regeneration-agent reservoir 21 furthermore comprises a telescopic loading hopper or slide 134 which is inserted in manually extractable manner into the salt-loading mouth 132*a* of the salt container 132. In the FIG. 16 embodiment, the regeneration-agent reservoir 21 furthermore comprises screw plug 135 which is inserted/screwed into the salt-loading mouth 132*a* in easily removable manner to seal preferably substantially in watertight manner the salt container 132.

Figure 17:
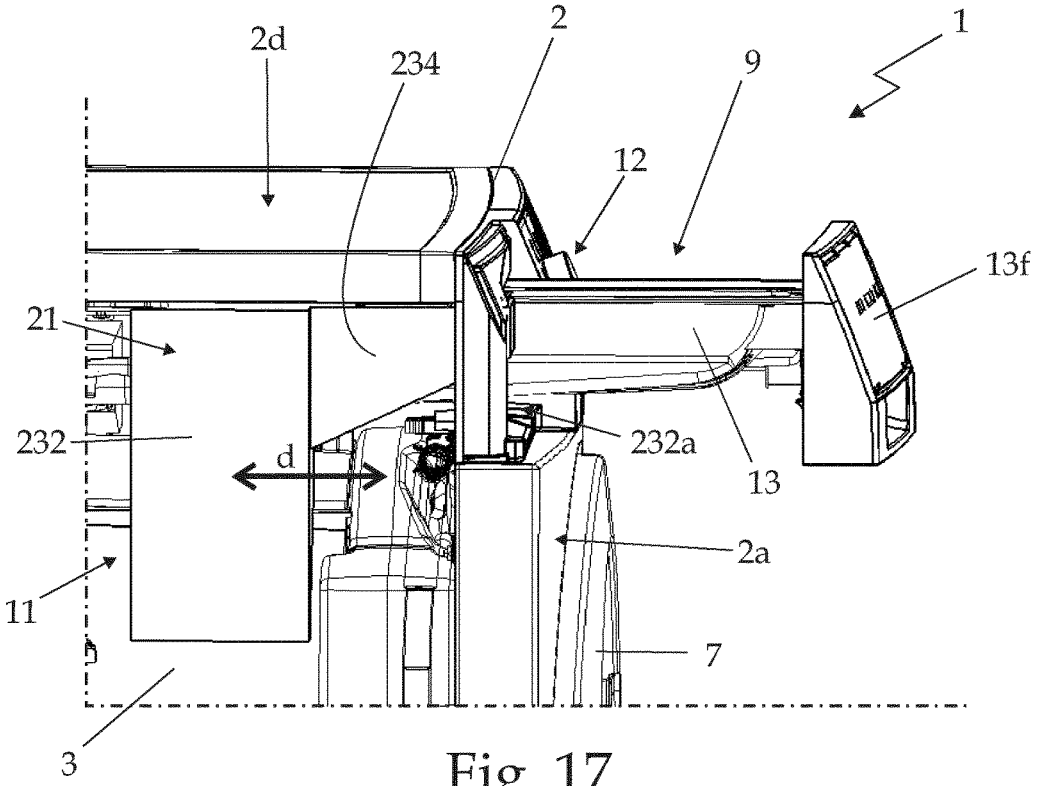
FIGS. 17 and 18 show two perspective views of a further alternative embodiment of the internal water softening device of the FIG. 1 laundry washing machine, with parts in section and parts removed for clarity.
Figure 18:
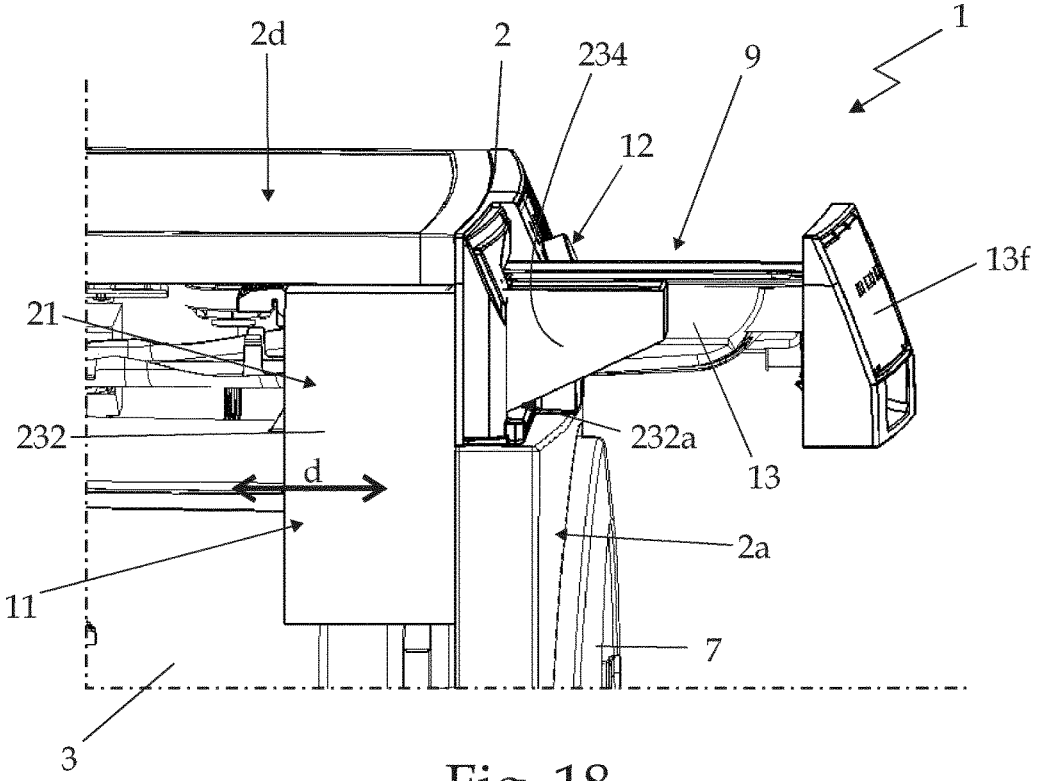

With reference to FIGS. 17 and 18, instead, the regeneration-agent reservoir 21 of the water softening device 11 may comprise a stand-alone modular salt container 232 which is fixed in a horizontally sliding manner onto the sidewall of the drawer housing or seat 14 of detergent dispenser 9, so as to be able to freely slide inside the casing 2 in a direction d locally substantially parallel to the displacement direction of detergent drawer 13, towards and backwards a pass-through opening 232*a* realized on the front wall 2*a* of casing 2 immediately beside the entrance/front opening 14*a* of the drawer housing or seat 14.

The regeneration-agent reservoir 21 is furthermore provided with a salt-loading hopper 234 that protrudes from a lateral wall of the salt container 232 directly faced to the front wall 2*a* of casing 2, and is shaped/dimensioned to engage the pass-through opening 234*a* on the front wall 2*a* of the boxlike casing 2 so as to jut out from the front wall 2*a* of casing 2 beside the salt drawer 13 when the salt container 232 is arranged at a minimum distance from the front wall 2*a* of casing 2.

Furthermore, in a first non-shown embodiment the regeneration-agent reservoir 21 preferably lacks the removable basket 34, and the bottom and/or at least one of sidewalls of the salt drawer 32 have a water-permeable meshed structure, so as to form the brine directly on the bottom of the drawer housing 33.

Finally in a second non-shown embodiment the basin-shaped drawer housing 33 of regeneration-agent reservoir 21 is realized in one piece with the basin-shaped drawer housing 14 of detergent dispenser 9, thus solely the resin container 23 consists in completely stand-alone modular component-part 23 which is provided with a mechanical coupling interface 23*a* structured for allowing rigid fastening and fluidical connection of the stand-alone modular component-part 23 directly to the detergent dispenser 9.

In other words, in this embodiment the detergent container housing of detergent dispenser 9 is provided with two independent seats respectively housing the detergent drawer 13 and the other housing the salt drawer 32. The regeneration-agent reservoir 21 is therefore integrally formed with the detergent container housing of detergent dispenser 9, and the resin container 23 is modularly connected to the bottom of the detergent container housing, preferably beneath the salt drawer 32.

The invention claimed is:

1. A laundry washing machine comprising an outer casing, a washing tub arranged inside said casing directly facing a laundry loading/unloading opening realized in a front wall of said casing, a rotatable drum arranged in an axially rotating manner inside the washing tub and structured for receiving the laundry to be washed, a detergent dispenser which is structured for supplying detergent into the washing tub, and a water softening device which is arranged inside the casing and is structured for reducing a hardness degree of fresh water supplied to the washing tub;

the water softening device comprising a water-softening agent container filled with a water softening agent able to reduce the hardness degree of the fresh water supplied to the washing tub, and a regeneration-agent reservoir fluidly connected to the water-softening container and structured to receive a salt or other regeneration agent for performing a regeneration of the water softening function of said water softening agents by a flow of water from the regeneration-agent reservoir to the water-softening container;

wherein at least one among the water-softening agent container and the regeneration-agent reservoir is a stand-alone modular component-part which is provided with a mechanical coupler structured for allowing rigid fastening of said stand-alone modular component-part to the detergent dispenser.

2. The laundry washing machine according to claim 1, wherein the detergent dispenser is provided with a first housing which extends inside the casing, and wherein at least one among the water-softening agent container and the regeneration-agent reservoir is structured for being rigidly fastened to the first housing of said detergent dispenser.

3. The laundry washing machine according to claim 2, wherein the regeneration-agent reservoir of the water softening device is arranged beside the first housing of the detergent dispenser.

4. The laundry washing machine according to claim 3, wherein the regeneration-agent reservoir is arranged beside the first housing of the detergent dispenser, in a direction locally substantially parallel to the front wall of the casing.

5. The laundry washing machine according to claim 3, wherein the regeneration-agent reservoir is provided with a mechanical coupler structured for allowing rigid fastening of the regeneration-agent reservoir to a sidewall of the first housing of said detergent dispenser.

6. The laundry washing machine according to claim 1, wherein the water-softening agent container is a stand-alone modular component-part which is provided with a mechanical coupler structured for allowing rigid fastening and fluid connection of the water-softening agent container to a bottom of the regeneration-agent reservoir.

7. The laundry washing machine according to claim 6, wherein said water-softening agent container is located beneath said regeneration-agent reservoir within a seat delimited by a lateral wall of the casing, an upper portion of the washing tub and the front wall of the casing.

8. The laundry washing machine according to claim 1, wherein the water-softening agent container is a stand-alone modular component-part which is provided with a mechanical coupler structured for allowing rigid fastening and fluid connection of the water-softening agent container to the detergent dispenser.

9. The laundry washing machine according to claim 1, wherein the detergent dispenser is provided with a complementary mechanical coupler structured for engaging the mechanical coupler of the at least one among the water-softening agent container and the regeneration-agent reservoir.

10. The laundry washing machine according to claim 2, wherein the detergent dispenser is exposed or exposable to the outside of the casing through the front wall of said casing.

11. The laundry washing machine according to claim 10, wherein said detergent dispenser comprises a detergent container which is fillable with a given quantity of detergent, softener and/or other washing agent, and is housed inside the casing into said first housing.

12. The laundry washing machine according to claim 11, wherein said detergent container is movable inside said first housing so as to be at least partly extractable from the first housing through a first opening on the front wall of the casing.

13. The laundry washing machine according to claim 1, wherein the regeneration-agent reservoir of the water softening device is exposed or exposable to the outside of the casing through the front wall of said casing.

14. The laundry washing machine according to claim 2, wherein the regeneration-agent reservoir comprises a regeneration-agent container which is fillable with a given quantity of regeneration agents, and is housed inside the casing into a corresponding second housing or seat.

15. The laundry washing machine according to claim 14, wherein the detergent dispenser comprises also the second housing or seat of said regeneration-agent reservoir.

16. The laundry washing machine according to claim 14, wherein said regeneration-agent container is movable inside said second housing or seat so as to be at least partly extractable from the second housing or seat through a second opening on the front wall of the casing.

17. The laundry washing machine according to claim 16, wherein a displacement direction of the regeneration-agent container inside the second housing or seat is locally substantially parallel to a displacement direction of a detergent container inside the first housing.

18. The laundry washing machine according to claim 17, wherein said detergent container and said regeneration-agent container are able to jut out from the front wall of the casing while remaining locally substantially parallel to one another.

19. The laundry washing machine according to claim 1, wherein said water softening device furthermore comprises a water supply circuit which is structured for selectively spilling/pouring a given amount of fresh water into the regeneration-agent reservoir to at least partly dissolve the regeneration agents stored therein forming a solution of regeneration agents; the water-softening agent container communicating with said regeneration-agent reservoir for receiving said solution of regeneration agents.

20. The laundry washing machine according to claim 1, wherein the water-softening agent container is arranged between the detergent dispenser and a main valve.

* * * * *